US011534726B2

(12) United States Patent
Doffing et al.

(10) Patent No.: US 11,534,726 B2
(45) Date of Patent: Dec. 27, 2022

(54) DISPENSING A SOLID CHEMISTRY USING AN ADJUSTABLE TURBULENT FLOW TECHNOLOGY MANIFOLD

(71) Applicant: ECOAB USA INC., Saint Paul, MN (US)

(72) Inventors: Brian Doffing, Saint Paul, MN (US); Daniel Schwartz, Saint Paul, MN (US); Kayla Claassen, Saint Paul, MN (US); Ryan Jacob Urban, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 788 days.

(21) Appl. No.: 16/389,308

(22) Filed: Apr. 19, 2019

(65) Prior Publication Data

US 2019/0321789 A1 Oct. 24, 2019

Related U.S. Application Data

(60) Provisional application No. 62/659,760, filed on Apr. 19, 2018.

(51) Int. Cl.
*B01F 1/00* (2006.01)
*B01F 15/00* (2006.01)
(Continued)

(52) U.S. Cl.
CPC ..... *B01F 21/221* (2022.01); *B01F 35/2217* (2022.01); *B01F 2035/351* (2022.01)

(58) Field of Classification Search
CPC .. B01F 21/22; B01F 35/71805; B01F 21/221; F16K 11/00; F16K 11/14; B05B 1/1654
See application file for complete search history.

(56) References Cited

U.S. PATENT DOCUMENTS 3,036,896 A 5/1962 MacKinnon
3,365,280 A 1/1968 Heiss et al.
(Continued)

FOREIGN PATENT DOCUMENTS

EP 0225859 B1 6/1987
EP 0259038 A2 3/1988
(Continued)

OTHER PUBLICATIONS

Ecolab USA Inc., PCT/US2014/016978 filed Feb. 18, 2014, "The International Search Report and the Written Opinion of the International Searching Authority, or the Declaration", dated Jun. 19, 2014.

(Continued)

*Primary Examiner* — Elizabeth Insler
(74) *Attorney, Agent, or Firm* — McKee, Voorhees & Sease, PLC

(57) ABSTRACT

A method for obtaining a chemical concentration from a chemical composition and a fluid includes introducing the fluid through ports in a manifold diffuse member positioned adjacent a chemical composition and adjusting, with a fluid valve, characteristics of the flow of the fluid through the ports in the diffuser manifold to obtain and maintain a chemical concentration. The amount of liquid allowed through the ports modifies the turbulence of the liquid, thereby modifying the erosion rate of the chemical composition. An apparatus for adjusting characteristics of the flow of a fluid contacting a solid product to form a product chemistry includes a diffuser manifold having a manifold diffuse member comprising ports therethrough and a fluid valve for controlling the flow rate of a fluid moving through the plurality of ports and diverting the fluid through various flow paths.

20 Claims, 23 Drawing Sheets

(51) Int. Cl.

| | |
|---|---|
| ***B01F 21/20*** | (2022.01) |
| ***B01F 35/221*** | (2022.01) |
| *B01F 35/30* | (2022.01) |

(56) References Cited

U.S. PATENT DOCUMENTS

| | | | | |
|---|---|---|---|---|
| 3,860,394 | A | 1/1975 | Tepas, Jr. et al. | |
| 3,864,090 | A | 2/1975 | Richards | |
| 3,929,151 | A | 12/1975 | Rubin | |
| 4,116,640 | A | 9/1978 | Leverenz | |
| 4,398,669 | A | 8/1983 | Fienhold | |
| 4,662,387 | A | 5/1987 | King, Sr. | |
| 4,790,981 | A | 12/1988 | Mayer et al. | |
| 5,076,315 | A | 12/1991 | King | |
| 5,192,431 | A | 3/1993 | Holmes | |
| 5,384,102 | A | 1/1995 | Ferguson et al. | |
| 5,389,344 | A | 2/1995 | Copeland et al. | |
| 5,427,748 | A | 6/1995 | Wiedrich et al. | |
| 5,441,073 | A | 8/1995 | Hoadley | |
| 5,441,711 | A | 8/1995 | Drewery | |
| 5,478,537 | A | 12/1995 | Laughlin et al. | |
| 5,660,802 | A | 8/1997 | Archer et al. | |
| 5,810,043 | A | 9/1998 | Grenier | |
| 5,878,781 | A | 3/1999 | Parker | |
| 5,897,770 | A | 4/1999 | Hatch et al. | |
| 6,416,662 | B1 | 7/2002 | Schmidt | |
| 7,661,607 | B1 * | 2/2010 | Bowden | E03C 1/046 239/581.1 |
| 9,278,364 | B2 * | 3/2016 | Zhou | B05B 1/1636 |
| 9,850,060 | B2 | 12/2017 | Freudenberg et al. | |
| 2005/0244315 | A1 | 11/2005 | Greaves et al. | |
| 2006/0083668 | A1 | 4/2006 | Thomas et al. | |
| 2012/0260997 | A1 | 10/2012 | Snetting et al. | |
| 2012/0273585 | A1 | 11/2012 | Broome | |
| 2013/0032647 | A1 * | 2/2013 | Zhou | B05B 1/1654 239/562 |
| 2014/0233346 | A1 | 8/2014 | Schultz et al. | |
| 2015/0129475 | A1 | 5/2015 | Pickens | |
| 2016/0038889 | A1 | 2/2016 | Freudenberg et al. | |
| 2017/0151539 | A1 | 6/2017 | Carroll et al. | |

FOREIGN PATENT DOCUMENTS

| | | | |
|---|---|---|---|
| FR | 1427464 | A | 2/1966 |
| WO | 2010027625 | A1 | 3/2010 |

OTHER PUBLICATIONS

Ecolab USA Inc, Application No. 14754429.0/PCT/US2014/016978, "Extended European Search Report" 8 pages, dated Nov. 29, 2016.

Ecolab USA Inc., PCT/US2019/028273 filed Apr. 19, 2019, "The International Search Report and the Written Opinion of the International Searching Authority, or the Declaration", 21 pages, dated Jul. 31, 2019.

* cited by examiner

DISPENSING A SOLID CHEMISTRY USING AN ADJUSTABLE TURBULENT FLOW TECHNOLOGY MANIFOLD

CROSS REFERENCE TO RELATED APPLICATIONS

This application claims priority under 35 U.S.C. § 119 to provisional patent application U.S. Ser. No. 62/659,760, filed Apr. 19, 2018. The provisional patent application is herein incorporated by reference in its entirety, including without limitation, the specification, claims, and abstract, as well as any figures, tables, appendices, or drawings thereof.

FIELD OF THE INVENTION

The invention relates generally to the formation of a product chemistry between a solid product chemistry and a fluid in contact with the solid product.

BACKGROUND OF THE INVENTION

Dissolution parameters of a solid product into a liquid solution, such as a liquid detergent used for cleaning and sanitizing, change based on the operating parameters of and inputs to the dissolution process. Spraying liquid onto a solid product to dissolve it into a liquid solution is one technique. With this technique, the operating parameters change in part based on characteristics within the dispenser, such as the distance between the solid product and the spray nozzle and the change in the pressure and temperature of the liquid being sprayed onto the solid product. Changes in a nozzle's flow rate, spray pattern, spray angle, and nozzle flow can also affect operating parameters, thereby affecting the chemistry, effectiveness, and efficiency of the concentration of the resulting liquid solution. In addition, dissolution of a solid product by spraying generally requires additional space within the dispenser for the nozzles spray pattern to develop and the basin to collect the dissolved product, which results in a larger dispenser.

Spraying the liquid onto the solid product chemistry may not be ideal. The liquid temperature may vary, which will produce varying concentrations of the solution formed between the chemistry and the liquid. In addition, spraying the liquid may not provide uniform erosion, as the water contacts the chemistry in a non-uniform manner. This could create uncertainties in the system, as it will not be clear when or how often the product needs to be replaced, or what the concentration of the produced solution is.

Using a turbulent pool or pool-like liquid source may be used to combat some of the issues. However, similar to spraying, changes in characteristics of the liquid or environment may still affect the concentration and erosion rate of the product chemistry. For example, the temperature of the liquid and flow characteristics of the liquid in contact with the solid product are but a few of the parameters that may affect the concentration of the solution and/or the erosion rate of the product. Additional external factors such as, but not limited to, humidity, room temperature, how often the device is used, etc. may also affect the erosion rate and thus, concentration of the formed solution.

Previous methods and apparatuses have been disclosed for adjusting a liquid in contact with a solid product chemistry to obtain a desired concentration of product chemistry and to provide a generally uniform erosion of the product. These designs typically utilize a movable object to seal different holes in order to generate more agitation and impingement force from fluid coming out of the turbulent flow technology manifold.

While these designs are effective for their purpose of providing a more uniform erosion of a solid product, there still exists a need in the art to improve upon said method and apparatus to provide a single dispenser capable of getting a range of concentrations off a single block of chemistry by altering flow paths rather than sealing small holes.

SUMMARY OF THE INVENTION

Therefore, it is a primary object, feature, or advantage of the present invention to improve on and/or overcome the deficiencies in the art.

It is another object, feature, and/or advantage of the invention to provide an apparatus that generates a ready to use chemical solution from a solid block of chemistry using fluid agitation, also known as turbulent flow technology or TFT, to erode the solid chemistry.

It is another object, feature, and/or advantage of the invention to provide an apparatus that mitigates issues associated with providing enough force to seal off multiple holes at one time.

It is another object, feature, and/or advantage of the invention to provide an apparatus that is durable.

It is another object, feature, and/or advantage of the invention to provide an apparatus that is easily used, manufactured, repaired, and disassembled.

It is another object, feature, and/or advantage of the invention to provide an apparatus that is aesthetically pleasing.

It is another object, feature, and/or advantage of the invention to provide an apparatus that is cost effective.

It is another object, feature, and/or advantage of the invention to provide a method to safely dispense a range of chemical concentrations using the aforementioned apparatus.

The previous list of objects, features, or advantages of the present invention are not exhaustive and do not limit the overall disclosure. Likewise, the following list of aspects or embodiments do not limit the overall disclosure. It is contemplated that any of the objects, features, advantages, aspects, or embodiments disclosed herein can be integrated with one another, either in full or in part, as would be understood from reading the present disclosure.

According to some aspects of the present disclosure, an apparatus for adjusting characteristics of the flow of a fluid contacting a solid product to form a product chemistry comprising a diffuser manifold having a manifold diffuse member and a fluid valve for controlling the flow rate of a fluid moving through the plurality of ports and selectively orienting a flow of the fluid through a first flow path, a second flow path, or a third flow path. The manifold diffuse member comprises a first side with ports therethrough and a second side having a first fluid path and a second fluid path determined by a flow geometry of the manifold diffuse member. The first fluid path and the second fluid path are intersected by the ports.

According to some additional aspects of the present disclosure, the fluid valve has a configuration to divert the fluid through the first flow path or the second flow path and the third flow path.

According to some additional aspects of the present disclosure, the fluid valve has a configuration to divert the fluid through the first flow path, the second flow path, and the third flow path.

According to some additional aspects of the present disclosure, fluid diverted through the first flow path travels through the first fluid path and fluid diverted through the second flow path travels through the second fluid path.

According to some additional aspects of the present disclosure, the fluid valve further comprises a static gasket to seal off the first flow path or the second flow path.

According to some additional aspects of the present disclosure, the fluid valve comprises an external component for driving rotation of an internal rotatable component. According to some additional aspects of the present disclosure, the external component is a handle or a cap.

According to some additional aspects of the present disclosure, the external component includes an indicator for indicating which flow paths are open or closed.

According to some additional aspects of the present disclosure, the rotatable component includes a rotary disc with holes therethrough.

According to some additional aspects of the present disclosure, plugs are inserted into at least some of the holes.

According to some additional aspects of the present disclosure, the fluid valve further comprises a stationary component which attaches to a base to form at least a portion of an external structure of the fluid valve.

According to some additional aspects of the present disclosure, the stationary component comprises flow control cavities.

According to some additional aspects of the present disclosure, stationary component comprises raised surfaces where the fluid exits the flow control cavities.

According to some additional aspects of the present disclosure, the fluid valve comprises a first static gasket for creating a watertight seal between the stationary component and the base.

According to some additional aspects of the present disclosure, the fluid valve comprises an external component for driving rotation of an internal rotatable component, said external component lockingly engaged to the base and said rotatable component positioned between the stationary component and the external component.

According to some additional aspects of the present disclosure, the fluid valve comprises a second static gasket for creating a watertight seal between the rotatable component and the base.

According to some additional aspects of the present disclosure, the stationary component and the base are attached with a ratchet and a pawl.

According to some additional aspects of the present disclosure, the ports have varying diameters.

According to some other aspects of the present disclosure, a dispenser configured to obtain a product chemistry from a product and a liquid, comprises a housing, a cavity within the housing for holding the product, a liquid source adjacent the cavity for providing a liquid to contact the product to create a product chemistry, a diffuser manifold, and a fluid valve for controlling the flow rate of a fluid moving through the diffuser manifold and diverting the fluid through a first flow path or a second flow path.

According to some additional aspects of the present disclosure, the dispenser further comprises an outlet operatively connected to the cavity to dispense the product chemistry from the dispenser.

According to some additional aspects of the present disclosure, the diffuser manifold is removably secured within the dispenser.

According to some additional aspects of the present disclosure, the flow rate is adjustable based on characteristics in the flow of the fluid moving through the diffuser manifold, said characteristics comprising velocity, pressure, turbulence, temperature, flow rate, vector, and/or impingement.

According to some additional aspects of the present disclosure, the dispenser further comprises a backflow prevention device.

According to some additional aspects of the present disclosure, the dispenser further comprises a product chemistry collector to collect the product chemistry.

According to some additional aspects of the present disclosure, the product chemistry collector comprises walls extending from the diffuser manifold.

According to some additional aspects of the present disclosure, the dispenser further comprises an overflow port located at a height of the walls extending from the diffuser manifold.

According to some additional aspects of the present disclosure, the dispenser further comprises a collection zone to collect product chemistry which passes through the overflow port.

According to some additional aspects of the present disclosure, the dispenser further comprises a splash guard to prevent the product chemistry in the collection zone from spilling outside the collection zone.

According to some other aspects of the present disclosure, a method for obtaining a chemical concentration from a chemical composition and a fluid comprises introducing the fluid through ports in a manifold diffuse member positioned adjacent a chemical composition and adjusting, with a fluid valve, characteristics of the flow of the fluid through the ports in the diffuser manifold to obtain and maintain a chemical concentration. The amount of liquid allowed through the ports modifies the turbulence of the liquid, thereby modifying the erosion rate of the chemical composition.

According to some additional aspects of the present disclosure, the characteristics of the flow include velocity, pressure, turbulence, temperature, flow rate, vector, and/or impingement.

According to some additional aspects of the present disclosure, the chemical composition is a solid product.

According to some additional aspects of the present disclosure, wherein the method further comprises providing the solid product.

According to some additional aspects of the present disclosure, the step of adjusting characteristics of the flow comprises diverting the fluid through a first flow path.

According to some additional aspects of the present disclosure, the step of adjusting characteristics of the flow comprises diverting the fluid through a second flow path.

According to some additional aspects of the present disclosure, the step of adjusting characteristics of the flow comprises diverting the fluid through a third flow path.

According to some additional aspects of the present disclosure, fluid diverted through the first flow path travels through a first fluid path determined by a flow geometry of the manifold diffuse member and fluid diverted through the second flow path travels through a second fluid path determined by said flow geometry.

According to some additional aspects of the present disclosure, rotating a handle causes the fluid valve to adjust the characteristics of the flow.

According to some additional aspects of the present disclosure, wherein the method further comprises dispensing the chemical concentration with a dispenser.

These or other objects, features, and advantages of the present invention will be apparent to those skilled in the art after reviewing the following detailed description of the illustrated embodiments, accompanied by the attached drawings.

Figure 1:
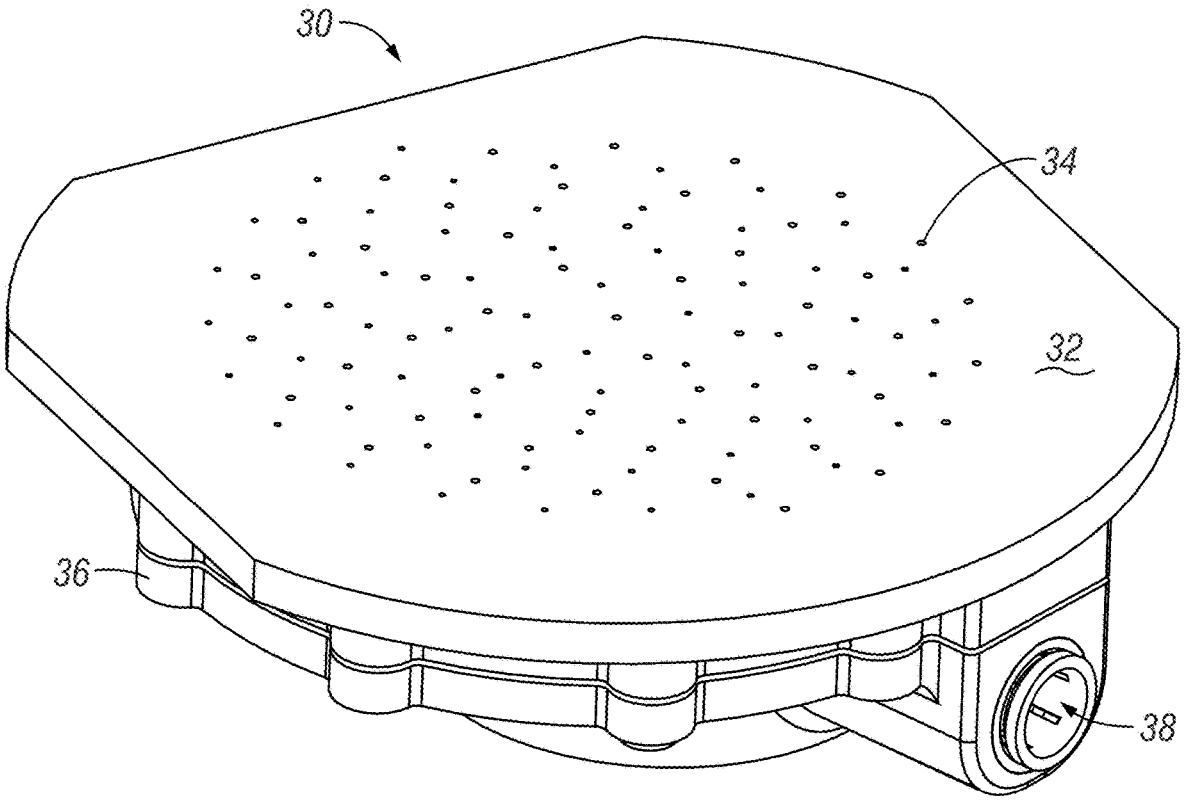
FIG. 1 shows a perspective view of a diffuser manifold, according to some aspects of the present disclosure.

Various embodiments of the present disclosure illustrate several ways in which the present invention may be practiced. These embodiments will be described in detail with reference to the drawings, wherein like reference numerals represent like parts throughout the several views. Reference to specific embodiments does not limit the scope of the present disclosure and the drawings represented herein are presented for exemplary purposes.

DETAILED DESCRIPTION OF THE PREFERRED EMBODIMENTS

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include plural referents unless context clearly indicates otherwise. Similarly, the word "or" is synonymous with "and/or" and is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

The term "about" as used herein refers to variation in the numerical quantities that can occur, for example, through typical measuring techniques and equipment, with respect to any quantifiable variable, including, but not limited to, mass, volume, time, distance, angle, wave length, frequency, voltage, current, and electromagnetic field. Furthermore, there is certain inadvertent error and variation that is likely through differences in the manufacture, source, or purity of the components used to make or carry out the present invention. The claims include equivalents to the quantities whether or not modified by the term "about."

The term "configured" describes an apparatus, system, or other structure that is constructed to perform or capable of performing a particular task or to adopt a particular configuration. The term "configured" can be used interchangeably with other similar phrases such as constructed, arranged, adapted, manufactured, and the like.

Terms such as first, second, vertical, horizontal, top, bottom, upper, lower, front, rear, end, sides, concave, convex, and the like, are referenced according to the views presented. These terms are used only for purposes of description and are not limiting unless these terms are expressly included in the claims. Orientation of an object or a combination of objects may change without departing from the scope of the invention.

The apparatuses, systems, and methods of the present invention may comprise, consist essentially of, or consist of the components of the present invention described herein. The term "consisting essentially of" means that the apparatuses, systems, and methods may include additional components or steps, but only if the additional components or steps do not materially alter the basic and novel characteristics of the claimed apparatuses, systems, and methods.

The terms "fluid path" and "flow path" are not used interchangeably herein. The definitions of these terms will be apparent to those skilled in the art after reading the entirety of the present disclosure.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

An apparatus for adjusting characteristics of the flow of a fluid contacting a solid product to form a product chemistry is shown in the figures.

Figure 2:
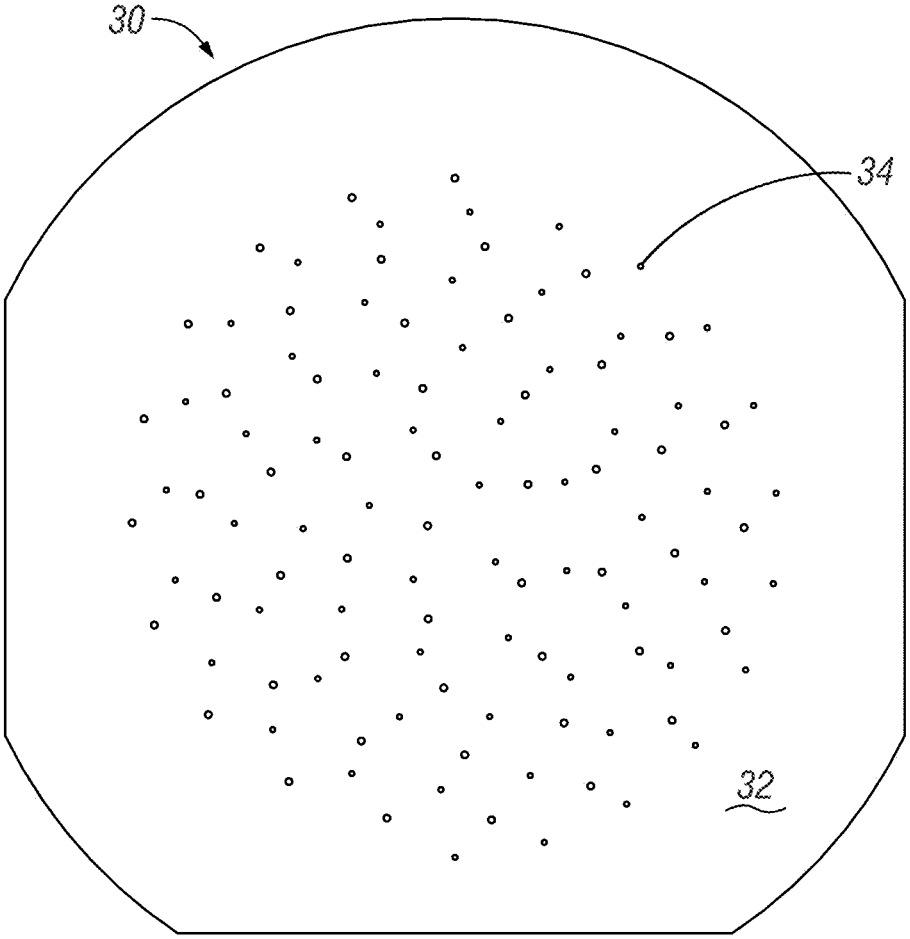
FIG. 2 shows an elevation view a manifold diffuse member, according to some aspects of the present disclosure.

Referring to FIGS. 1-2, a diffuser manifold 30 comprises a manifold diffuse member 32 having ports 34 therethrough and a valve housing 36 for housing a fluid valve, such as a rotary fluid valve 38. The diffuser manifold 30 is a device which can affect turbulence in fluid flow. The fluid valve may be located anywhere on the diffuser manifold 30. The fluid valve may be actuated manually or electronically. The fluid valve may be designed as a linear valve (e.g. a hydraulic valve system) or a magnetically actuated valve (e.g. a push button or electric solenoid). Integral to the fluid valve are flow controls (not shown). Different chemistries and different chemical concentrations require different flow rates of fluid in order to achieve desired concentrations. In addition, as ambient conditions (water temperature, humidity, ambient temperature, etc.) change, the flow of a fluid can be adjusted to attempt to maintain a desired concentration of a solution formed between the fluid and a solid chemical product. The number and size of the holes act as a flow restrictor, but adding in a flow control at a desired flow rate is another method to ensure concentration targets.

Figure 3A:
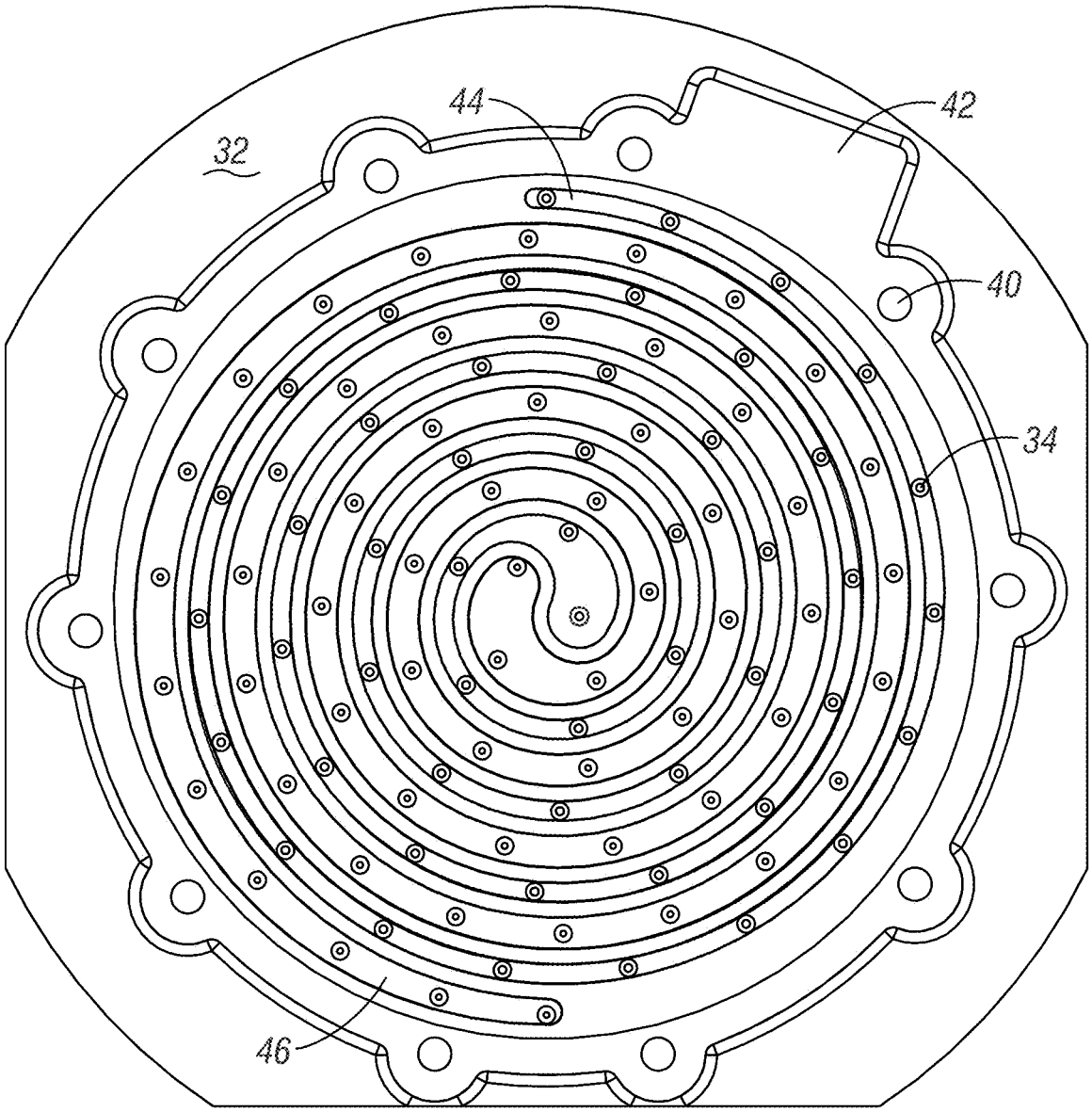
FIG. 3A shows a section view of an exemplary flow geometry for a manifold diffuse member having a first fluid path and a second fluid path, according to some aspects of the present disclosure.
Figure 3B:
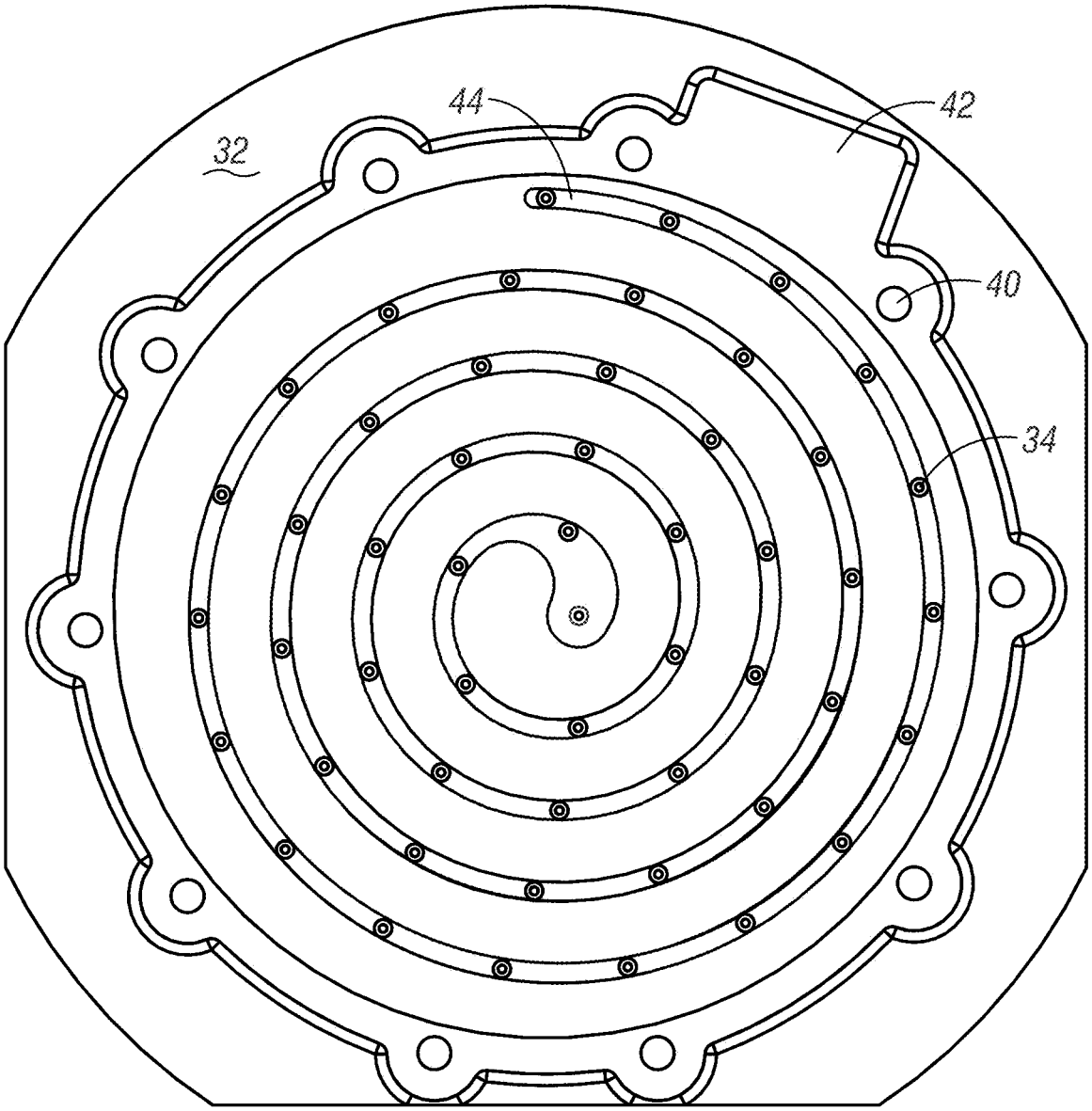
FIG. 3B shows a section view of the exemplary flow geometry of FIG. 3A with the second flow path removed, according to some aspects of the present disclosure.
Figure 3C:
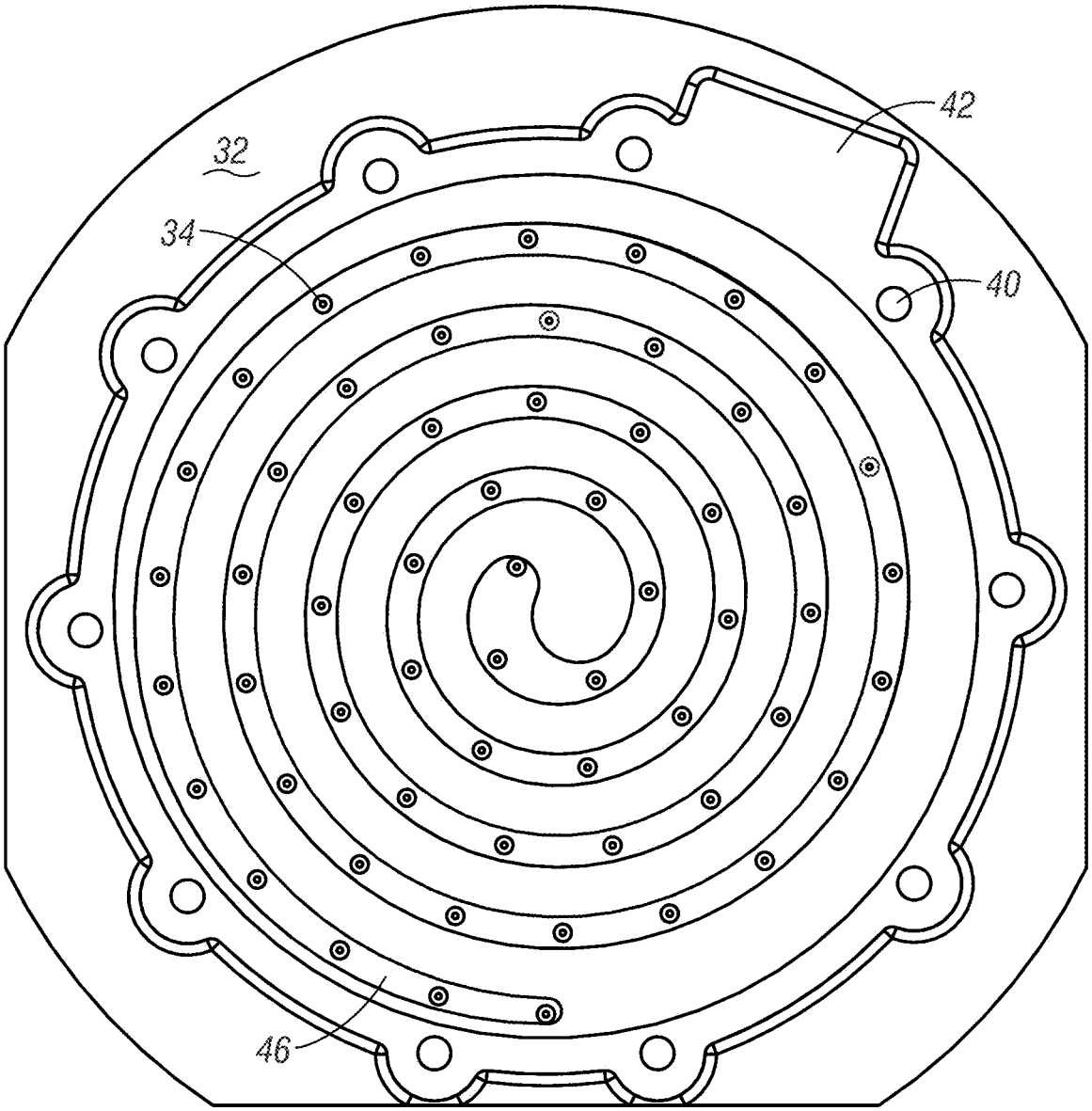
FIG. 3C shows a section view of the exemplary flow geometry of FIG. 3A with the first fluid path removed, according to some aspects of the present disclosure.

As shown in FIG. 3A, the manifold diffuse member 32 is removably secured to the valve housing 36 through fasteners which engage mounting apertures 40 in both the manifold diffuse member 32 and the valve housing 36. Non-limiting examples of fastening mechanisms may be mechanical in nature and can include screws, nuts, bolts, pins, washers, grommets, ties, latches (including pawls), rivets, staples, latches, clamps, clasps, adhesives, welds, any combination of the preceding components, and the like. The use of some fastening components may even eliminate the need for mounting apertures 40. Still further, it is contemplated that the components be one-piece, such as by additive manufacturing (e.g., 3D printing), molding, welding, or the like.

To help facilitate fastening and to prevent movement between the manifold diffuse member 32 and the valve housing 36, a lower edge of the manifold diffuse member 32 matingly engages an upper edge of the valve housing 36. The mating engagement may, for example, comprise a first interlocking component or portion on the manifold diffuse member 32 and a second opposite and corresponding interlocking component or portion on the valve housing 36. The interlocking components or portions may be selected from the group consisting of tabs (such as mounting tab 42), flanges, protrusions, recesses, indents, and the like. Alternatively, the manifold diffuse member 32 and at least some portions of the valve housing 36 may be integrally formed with one another, thereby eliminating the need for fastening mechanisms and/or interlocking components or portions.

The diffuser manifold 30 of FIGS. 3A-3C, 4A-4C, and 5A-5C utilizes a first fluid path 44 and a second fluid path 46. However, not all embodiments will employ the use of just two fluid paths. As the number of fluid paths is only one variable in determining the concentration of chemicals to be dispensed, the number of fluid paths may be varied or customized. The fluid paths 44, 46 may be configured many different ways by changing: flow controls—orifices that control the volume of fluid flowing into a path; manifold diffuse port 34/hole size—which may vary depending on the solid chemistry that is used; and the number of manifold diffuse ports 34/holes—as increasing or decreasing the number of manifold diffuse ports 34 or holes has a direct effect on the flow rate of the fluid coming out of the holes. The fluid paths 44, 46 help create distinct flow paths for the fluid. A fluid path may be comprised of several smaller fluid subpaths. If the fluid path includes smaller fluid subpaths which are particularly wide or which include large gaps, the flow geometry of the manifold diffuse member 32 may be supplemented with support members 48, such as posts, walls, or the like. The support members 48 are preferably positioned to not substantially interrupt the flow of a fluid path 44, 46.

As shown in FIG. 3A, the manifold diffuse member 32 comprises a spiral design with a center which looks like a taichi symbol (the symbol used to represent yin and yang). The spiral design comprises two separate spiral shaped fluid paths. The second fluid path 46 is removed in FIG. 3B such that the first fluid path 44 can be seen alone. Similarly, the first fluid path 44 is removed in FIG. 3C such that the second fluid path 46 can be seen alone.

Figure 4A:
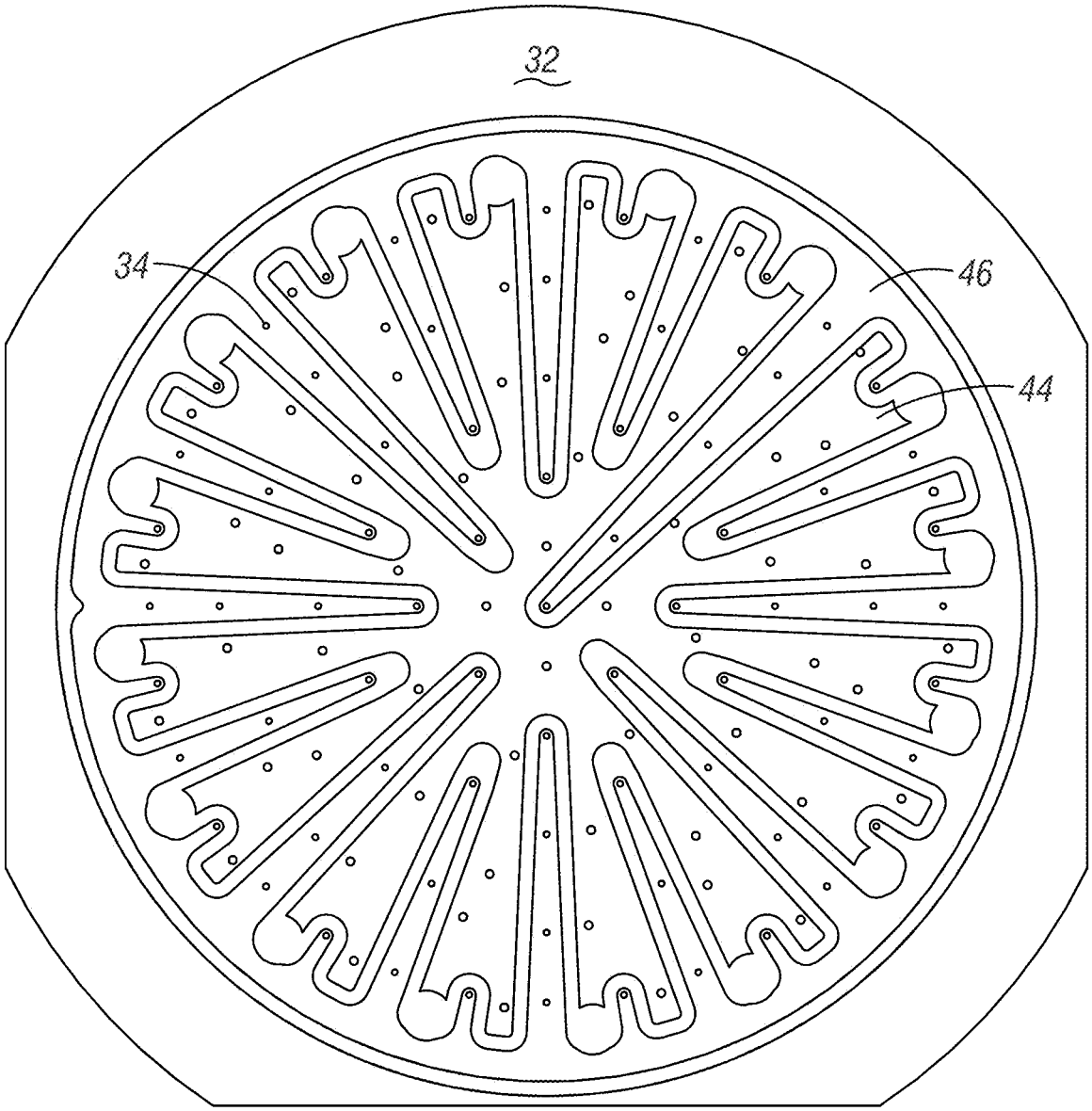
FIG. 4A shows a section view of an alternative exemplary flow geometry for a manifold diffuse member having a first fluid path and a second fluid path, according to some aspects of the present disclosure.
Figure 4B:
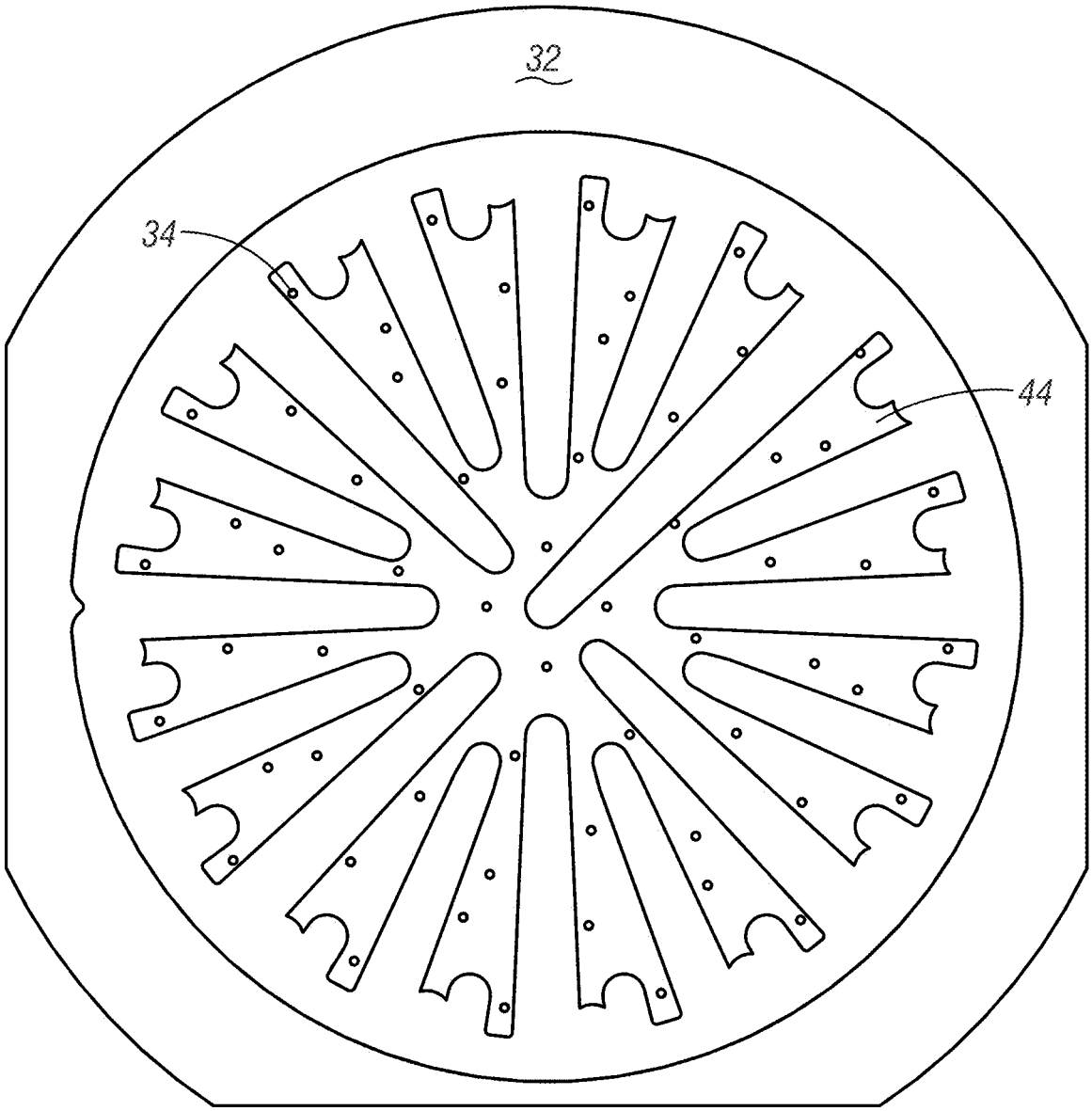
FIG. 4B shows a section view of the alternative exemplary flow geometry of FIG. 4A with the first second path removed, according to some aspects of the present disclosure.
Figure 4C:
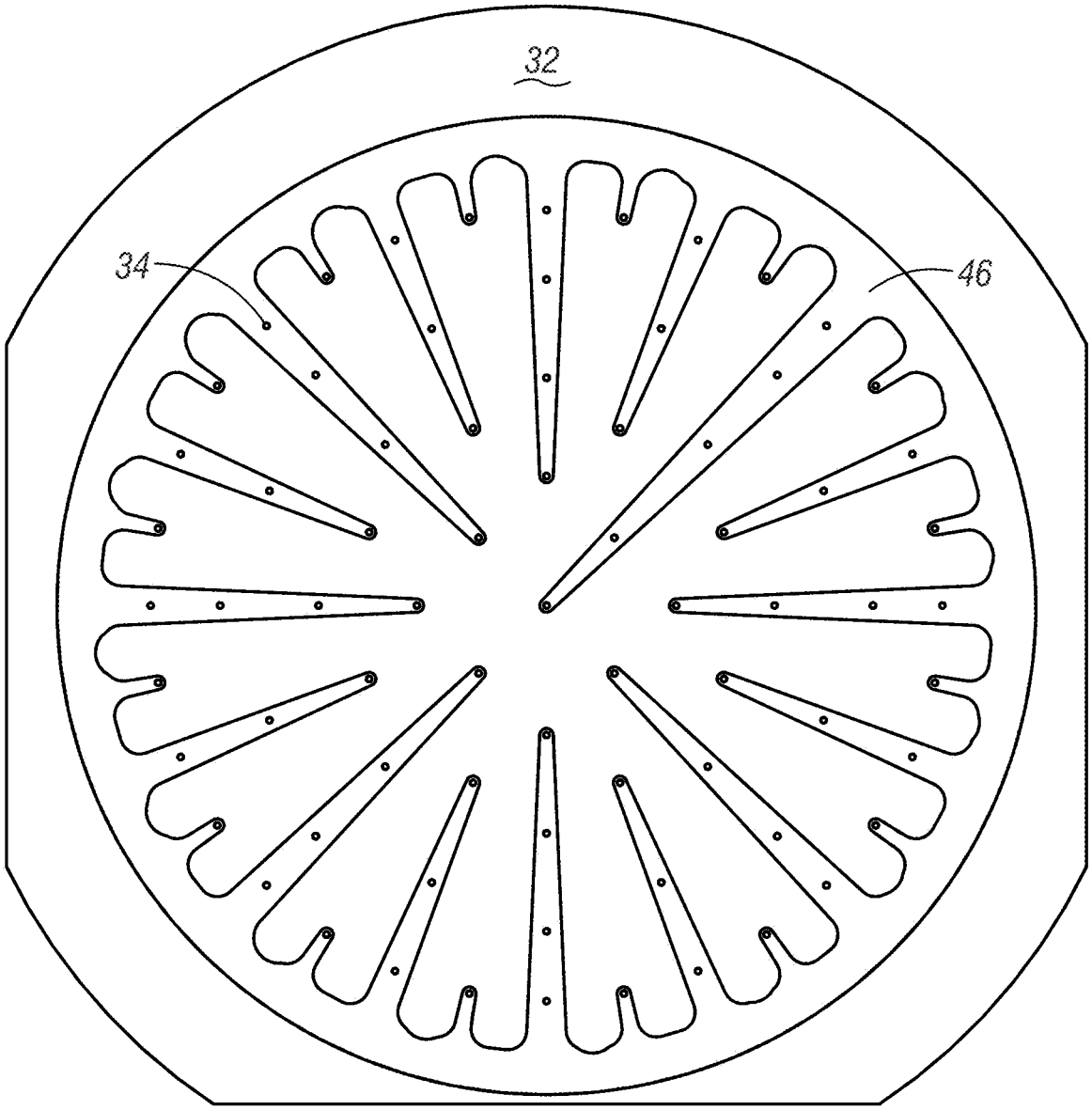
FIG. 4C shows a section view of the alternative exemplary flow geometry of FIG. 4A with the first fluid path removed, according to some aspects of the present disclosure.

As shown in FIG. 4A, the manifold diffuse member 32 comprises a "lily pad" design with a plurality of veins which extend inwardly towards a center from a circumferential location. The "lily pad" design comprises two separate fluid paths: the first fluid path 44 comprises "inner leaves" of the "lily pad"; and the second fluid path 46 comprises a circumferential ring (radially spaced) and the veins which extend inwardly towards a center from a circumferential location. The second fluid path 46 is removed in FIG. 4B such that the first fluid path 44 can be seen alone. Similarly, the first fluid path 44 is removed in FIG. 4C such that the second fluid path 46 can be seen alone.

Figure 5A:
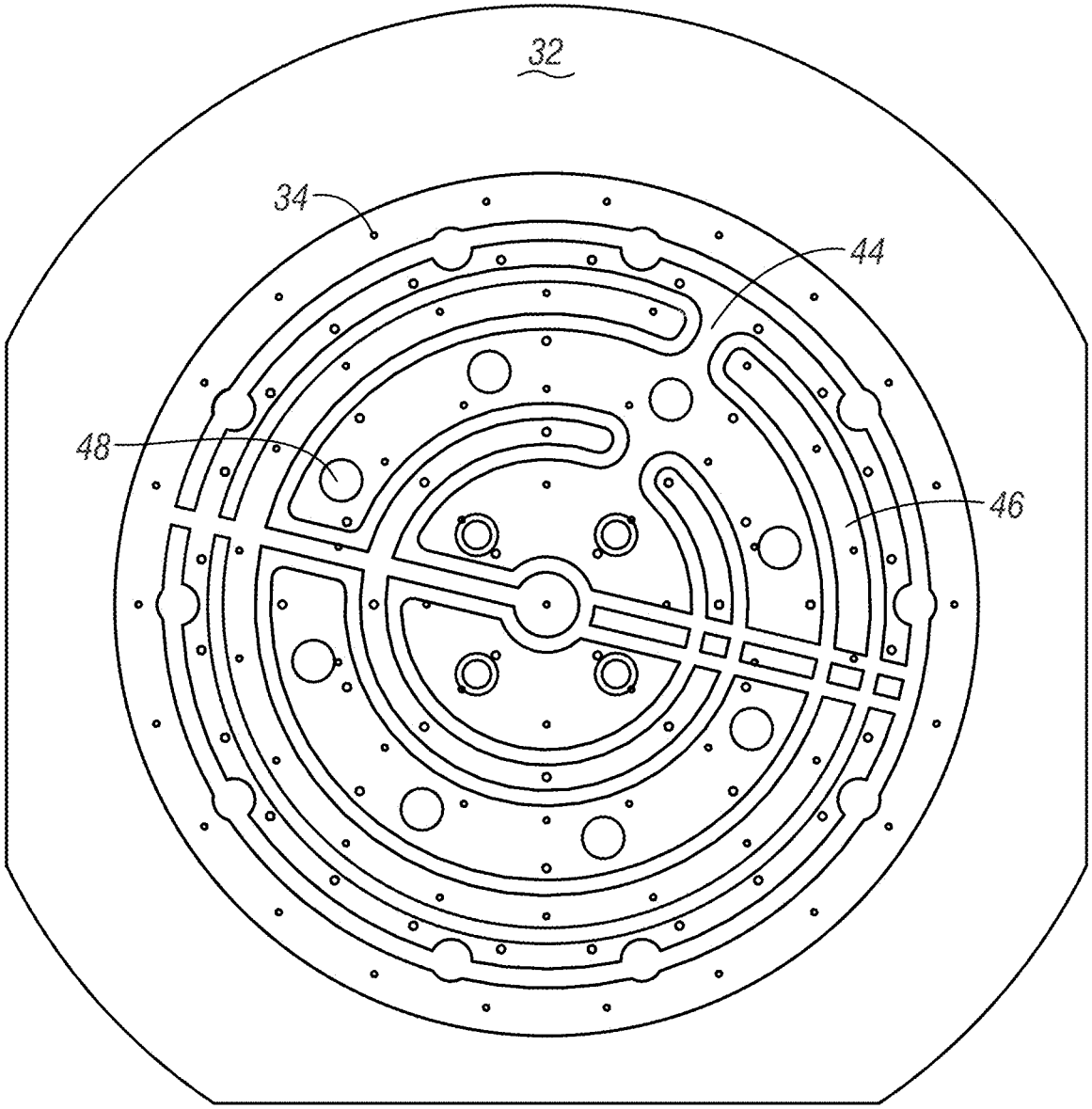
FIG. 5A shows a section view of yet another alternative exemplary flow geometry for a manifold diffuse member having a first flow path and a second fluid path, according to some aspects of the present disclosure.
Figure 5B:
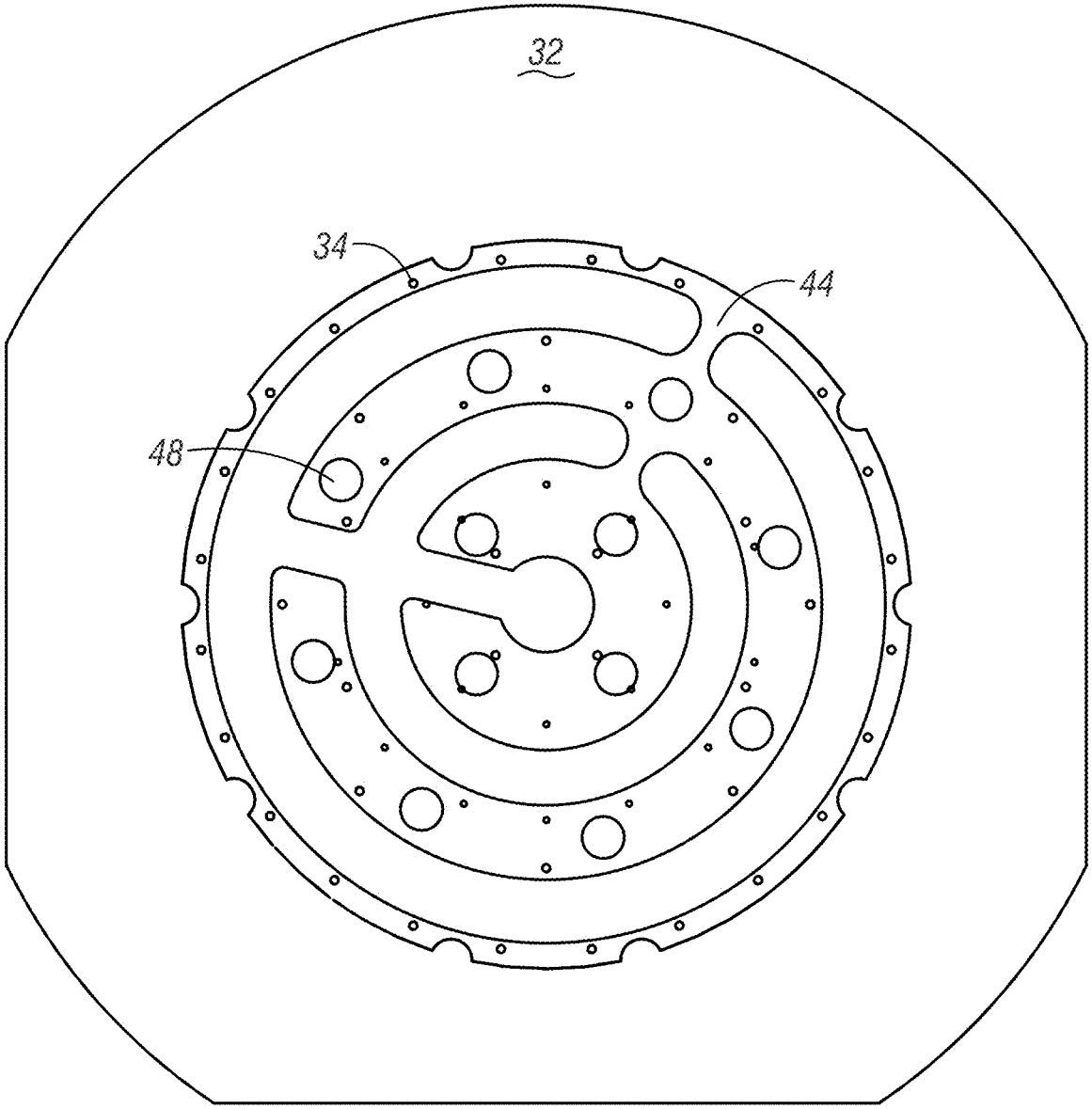
FIG. 5B shows a section view of the alternative exemplary flow geometry of FIG. 5A with the second flow path removed, according to some aspects of the present disclosure.
Figure 5C:
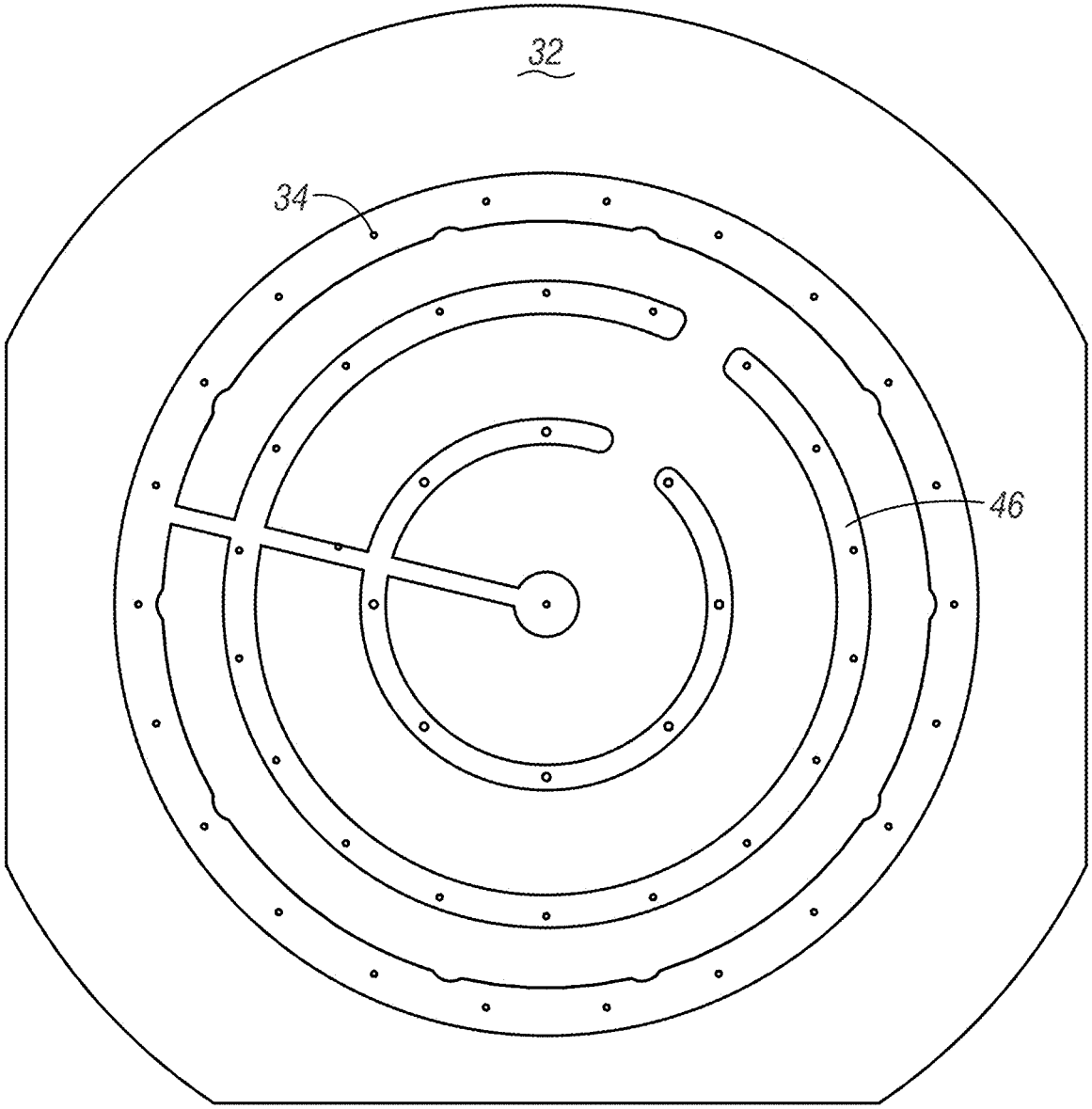
FIG. 5C shows a section view of the alternative exemplary flow geometry of FIG. 5A with the first fluid path removed, according to some aspects of the present disclosure.

As shown in FIG. 5A, the manifold diffuse member 32 comprises a concentric, circular design. The concentric design comprises two separate fluid paths: the first fluid path 44 resembles concentric paths; and the second fluid path 46 comprises a closed outer ring and two open inner rings, wherein each of the rings are connected to one another through a single subpath which starts from a location on the outer ring and extends radially inward towards a center. The second fluid path 46 is removed in FIG. 5B such that the first fluid path 44 can be seen alone. Similarly, the first fluid path 44 is removed in FIG. 5C such that the second fluid path 46 can be seen alone.

The present disclosure is not limited to the designs illustrated in FIGS. 3A-3C, FIGS. 4A-4C, and FIGS. 5A-5C. Computation Fluid Dynamics (CFD) may be used to evaluate the effectiveness of a seemingly infinite number of designs. The effectiveness of a design may be determined by whether a constant fluid velocity and fluid pressure within the cavity the fluid is flowing may be achieved.

Figure 6:
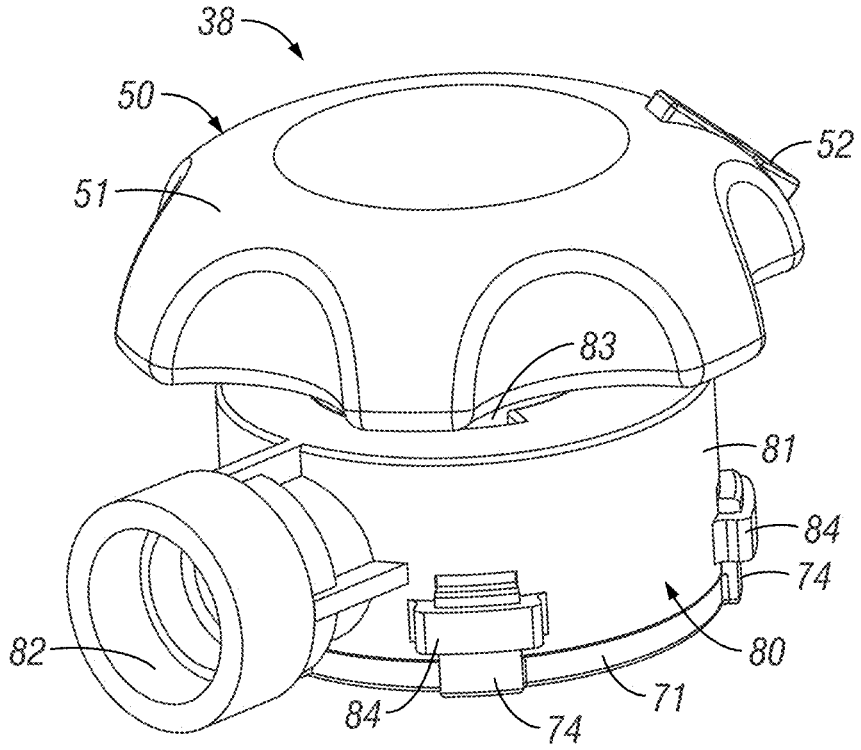
FIG. 6 shows a perspective view of an exemplary rotary fluid valve, according to some aspects of the present disclosure.
Figure 7:
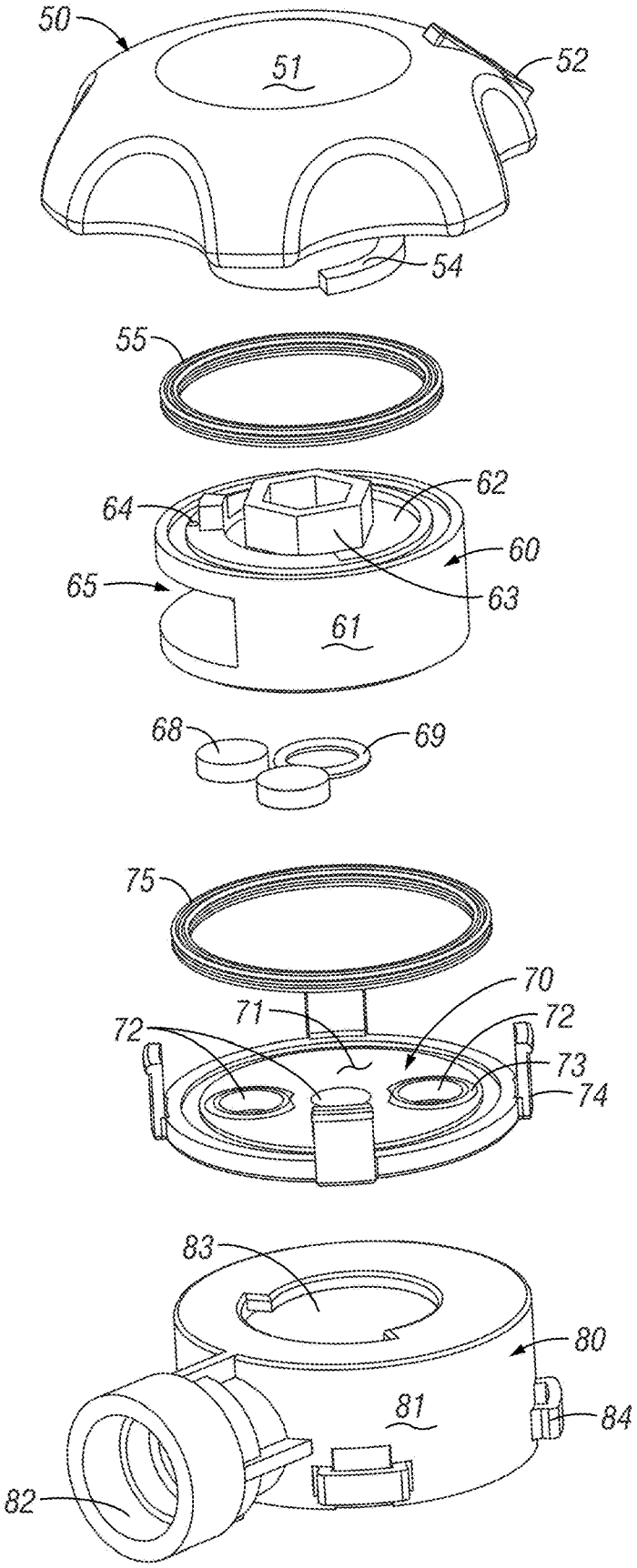
FIG. 7 shows an exploded view of an exemplary rotary fluid valve, according to some aspects of the present disclosure.
Figure 8:
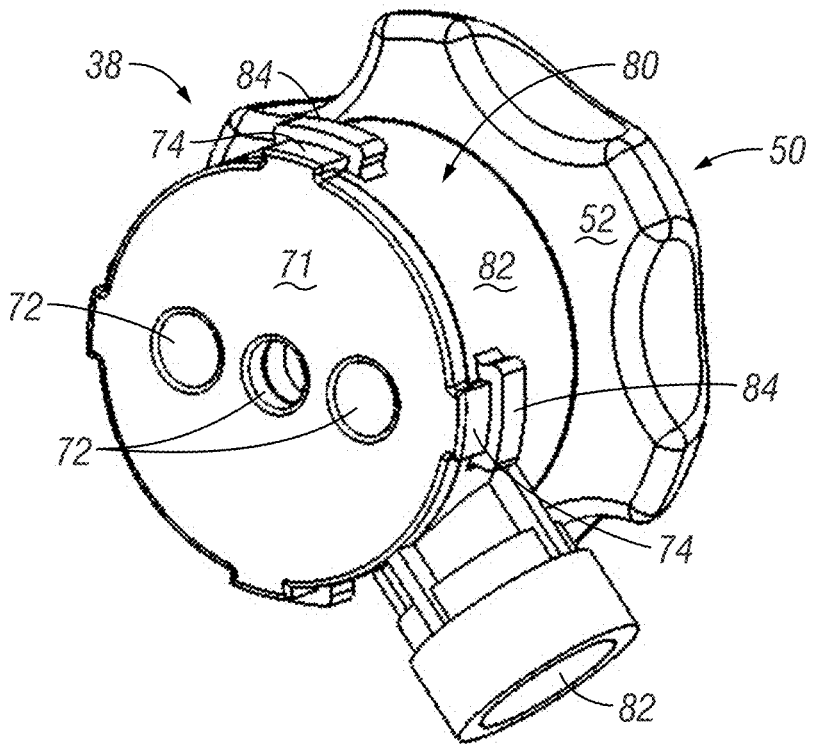
FIG. 8 shows another perspective view of the exemplary rotary fluid valve of FIG. 6, according to some aspects of the present disclosure.

A rotary fluid valve 38 for controlling the flow rate of a fluid moving through the plurality of manifold diffuse ports 34 is shown in FIG. 6. The components of the rotary fluid valve 38 are particularly shown in FIG. 7. FIG. 7 also suggests an order in which the components may be be assembled. FIG. 8 presents the rotary fluid valve 38 from a different perspective than the perspective used in FIG. 6 to show some remaining components not seen in FIGS. 6-7.

Figure 9:
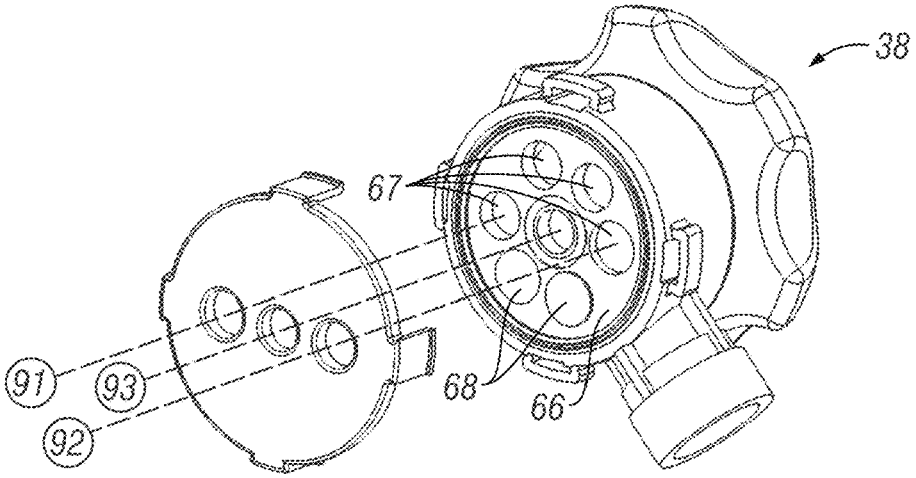
FIG. 9 shows a partially exploded view of the exemplary rotary fluid valve of FIG. 8 with a first flow path and a second flow path open, according to some aspects of the present disclosure.
Figure 10:
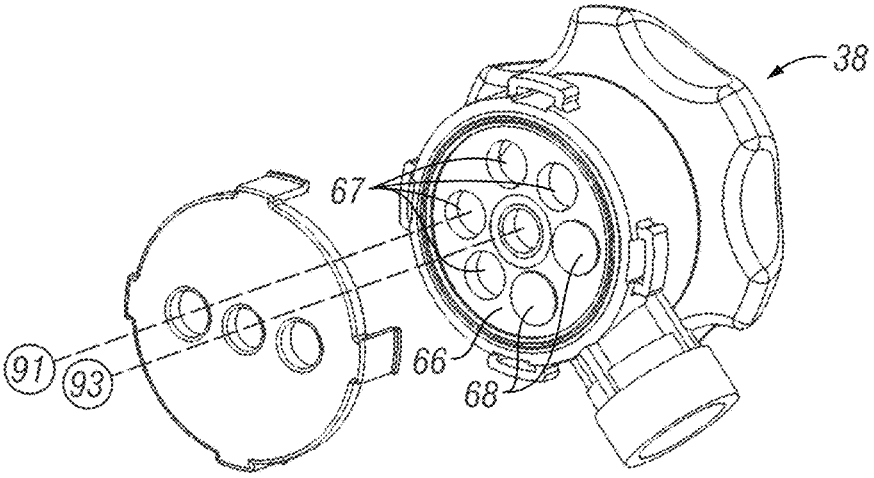
FIG. 10 shows a partially exploded view of the exemplary rotary fluid valve of FIG. 8 with the first flow path closed and the second flow path open, according to some aspects of the present disclosure.
Figure 11:
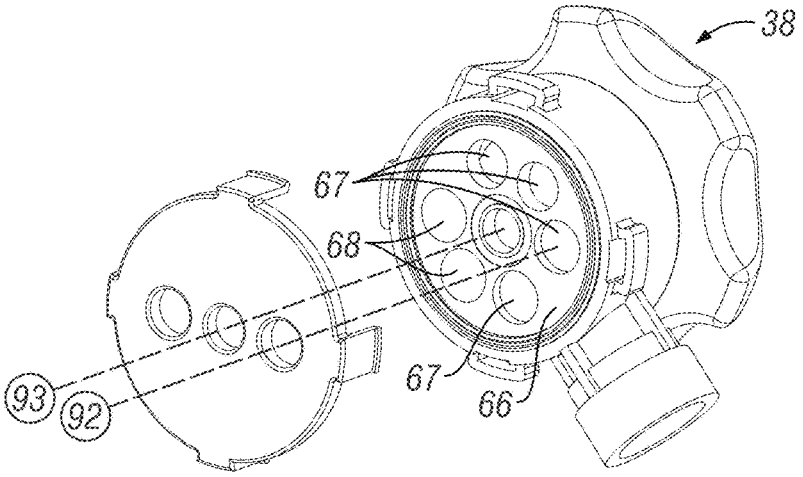
FIG. 11 shows a partially exploded view of the exemplary rotary fluid valve of FIG. 8 with the first flow path open and the second flow path closed, according to some aspects of the present disclosure.

FIGS. 9-11 present the rotary fluid valve 38 from the same perspective than the perspective used in FIG. 8 however the rotatable component 60 has been separated from the stationary component 70 to illustrate how the rotary fluid valve 38 diverts fluid through a first flow path 91, a second flow path 92, and/or a third flow path 93. Opening or closing flow paths 91, 92, and 93 may cause fluid to start or stop traveling through one or more fluid paths 44, 46 in the diffuser manifold 30. While each flow path may correspond directly to a specific fluid path(s), it is also possible a flow path does not correspond with any fluid paths in the diffuser manifold 30. For example, the rotary disc 66 may comprise a center rotary disc hole 67 which is always open.

The overall flow path of the fluid may be changed using the rotary fluid valve 38. In particular, the rotary fluid valve 38 has three different flow path configurations depending on which rotary disc holes 67 are plugged and which position the rotary disc 66 is in, thereby determining which flow control cavities 72 are open or closed. The center hole of the rotary fluid valve 38 is always open. Thus, a first configuration of the rotary fluid valve 38 exists where the first flow path 91, the second flow path 92, and the third flow path 93 are open, as is shown in FIG. 9; a second configuration exists where the first flow path 91 and the third flow path 93 are open, as is shown in FIG. 10; and a third configuration exists where the second flow path 92 and the third flow path 93 are open, as is shown in FIG. 11. A configuration exists where both the first fluid path 91 and the second fluid path 92 are closed and only the third fluid path 93 remains open. Alternatively, configurations exist wherein the third fluid path 93 is closed or does not exist. For example, the center rotary disc hole 67 may be removed entirely, which may allow for easier machining and/or injection molding.

The rotary fluid valve 38 reduces a need to seal off each individual port 34 within the diffuser manifold 30. The rotary disc holes 67 may be plugged valve seals 68, such as rubber or silicone plugs, however other materials could be used. For example, solenoid valves may also be considered and used to selectively open one or more of the rotary disc holes 67. The solenoid valves may be operated manually, automatically based upon an input, or some hybrid combination. Such inputs could be temperature, flow rate, water hardness, and/or other inputs that could affect the erosion of the solid product. The valve seals 68 may be die cut and placed into the rotary disc holes 67 and/or flow control cavities 72 of the stationary component 70 of the rotary fluid valve 38. Static gaskets 69, such as O-rings, may be used to help compress and seal off the first flow path 91 and/or the second flow path 92 when the rotary fluid valve 38 is rotated.

Figure 12:
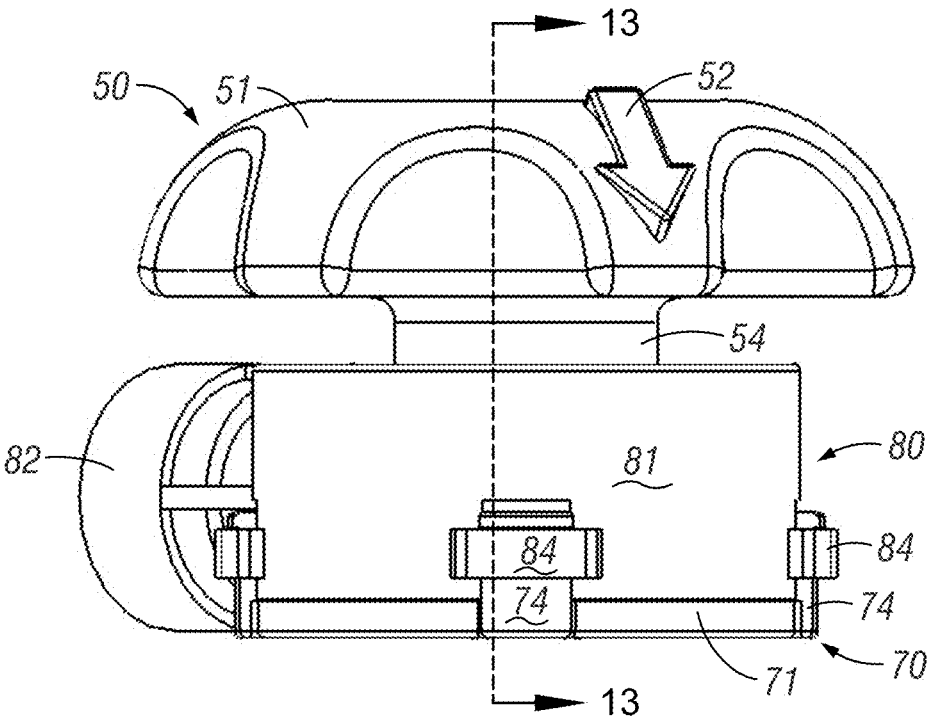
FIG. 12 shows an elevation view of the exemplary rotary fluid valve of FIG. 6, according to some aspects of the present disclosure.
Figure 13:
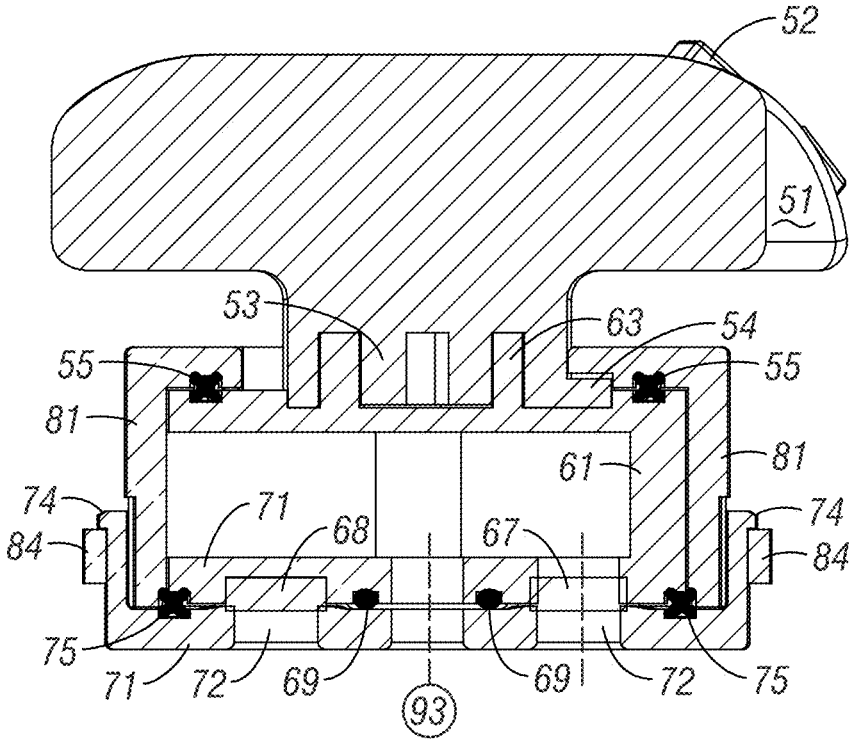
FIG. 13 shows a section view of the exemplary rotary fluid valve of FIG. 12 with the first flow path closed and the second flow path open, according to some aspects of the present disclosure.
Figure 14A:
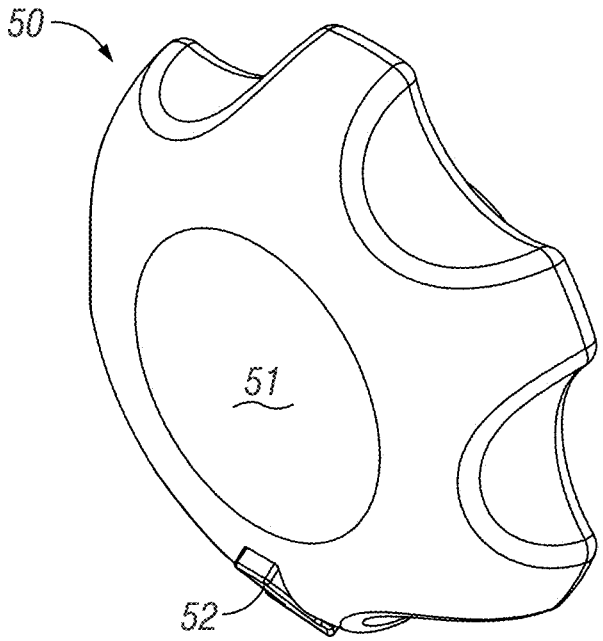
FIG. 14A shows a perspective view of a cap which forms part of the rotary fluid valve, according to some aspects of the present disclosure.
Figure 14B:
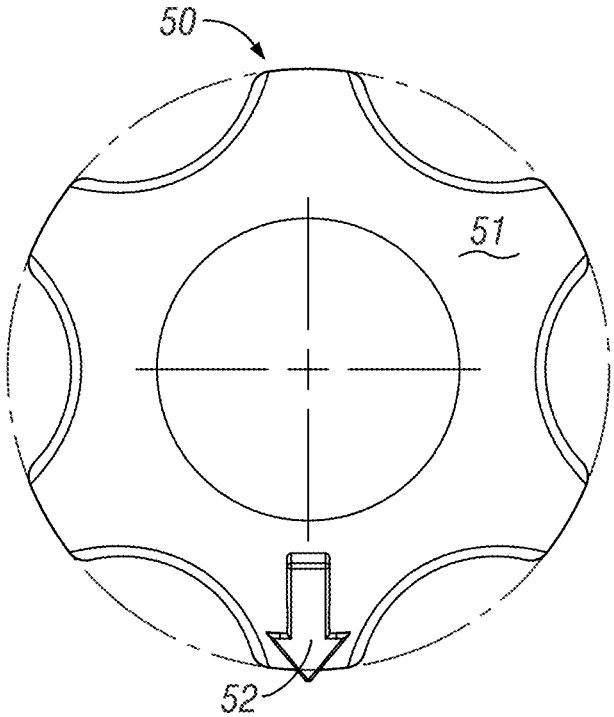
FIG. 14B shows a top section view of the cap of FIG. 14A, according to some aspects of the present disclosure.
Figure 14C:
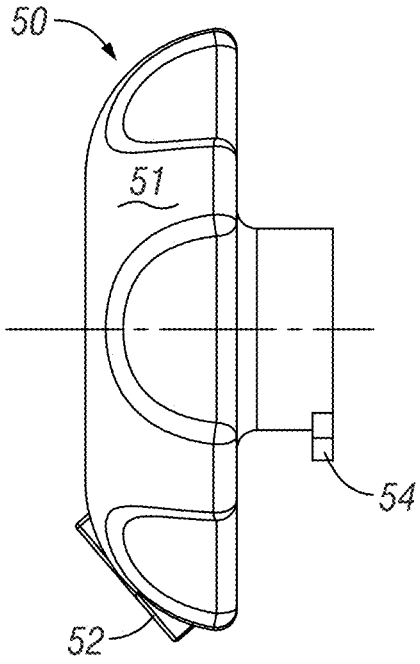
FIG. 14C shows a side section view of the cap of FIG. 14A, according to some aspects of the present disclosure.
Figure 15A:
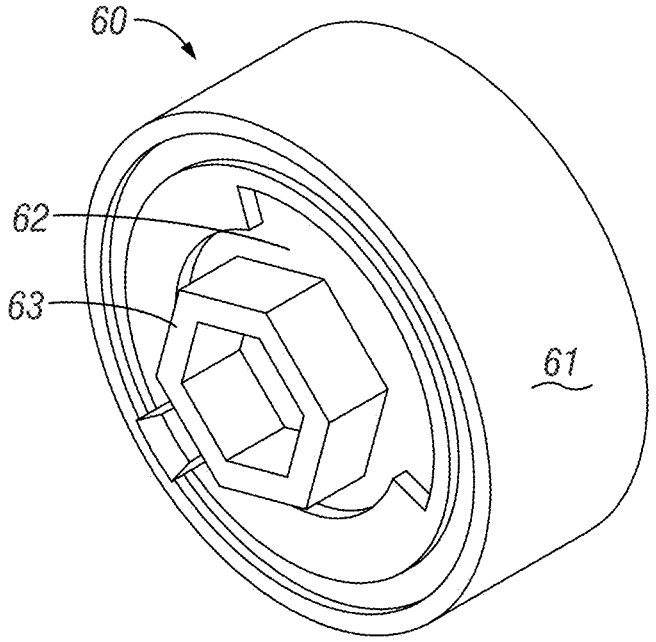
FIG. 15A shows a perspective view of a rotatable component which forms part of the rotary fluid valve, according to some aspects of the present disclosure.
Figure 15B:
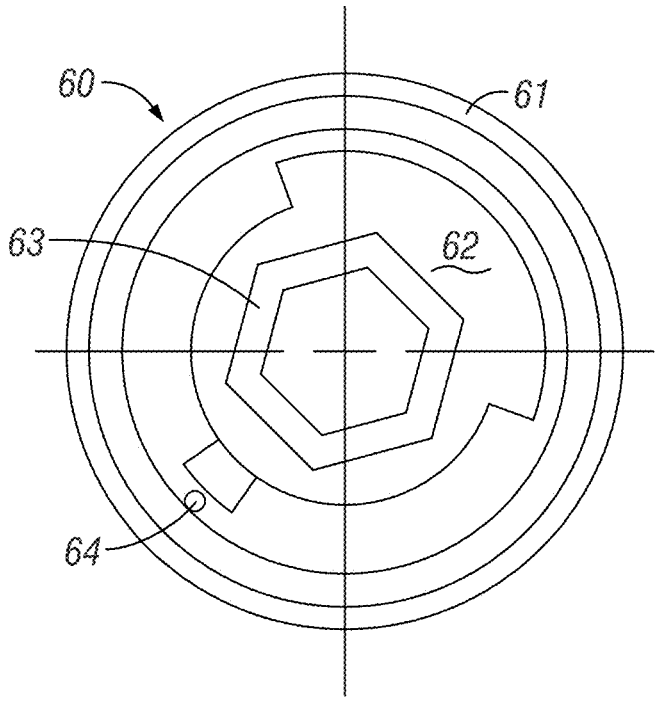
FIG. 15B shows a top section view of the rotatable component of FIG. 15A, according to some aspects of the present disclosure.
Figure 15C:
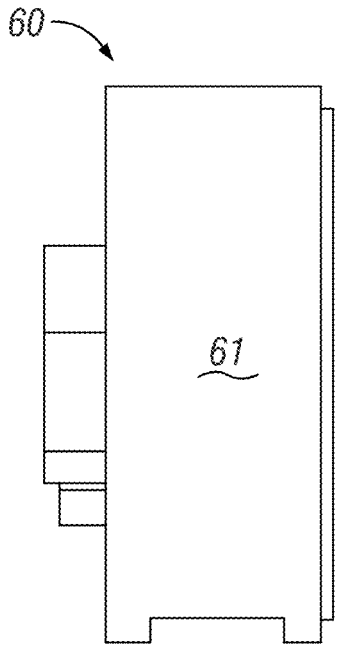
FIG. 15C shows a side section view of the rotatable component of FIG. 15A, according to some aspects of the present disclosure.
Figure 16A:
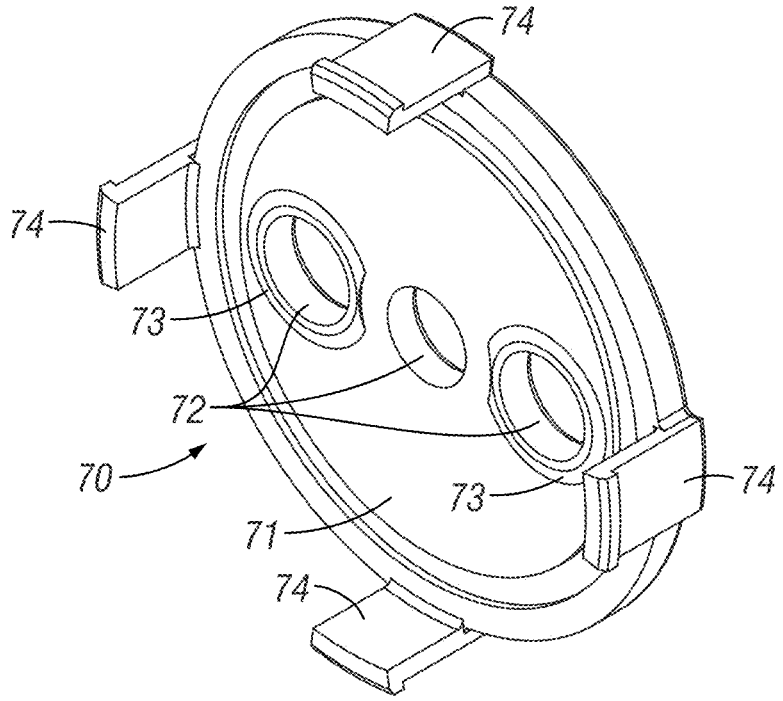
FIG. 16A shows a perspective view of a stationary component which forms part of the rotary fluid valve, according to some aspects of the present disclosure.
Figure 16B:
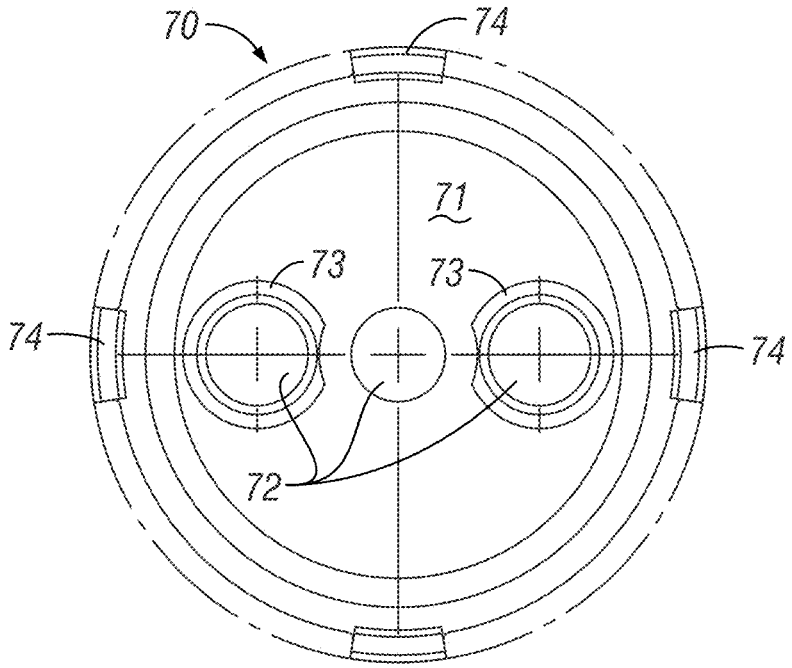
FIG. 16B shows a top section view of the stationary component of FIG. 16A, according to some aspects of the present disclosure.
Figure 16C:
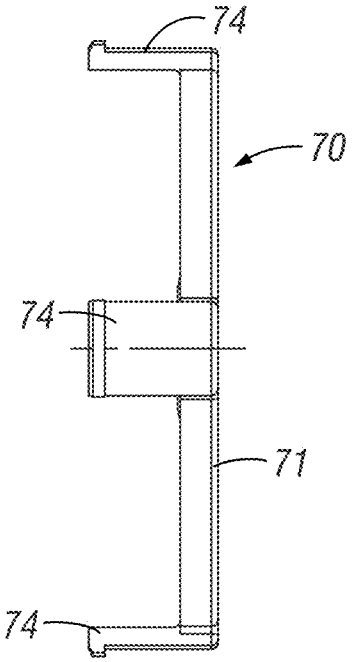
FIG. 16C shows a side section view of the stationary component of FIG. 16A, according to some aspects of the present disclosure.
Figure 17A:
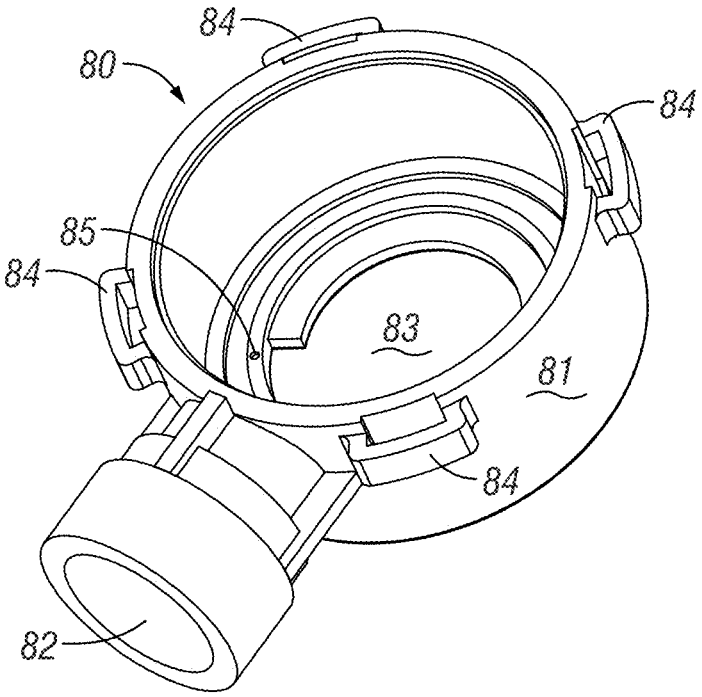
FIG. 17A shows a perspective view of a base which forms part of the rotary fluid valve, according to some aspects of the present disclosure.
Figure 17B:
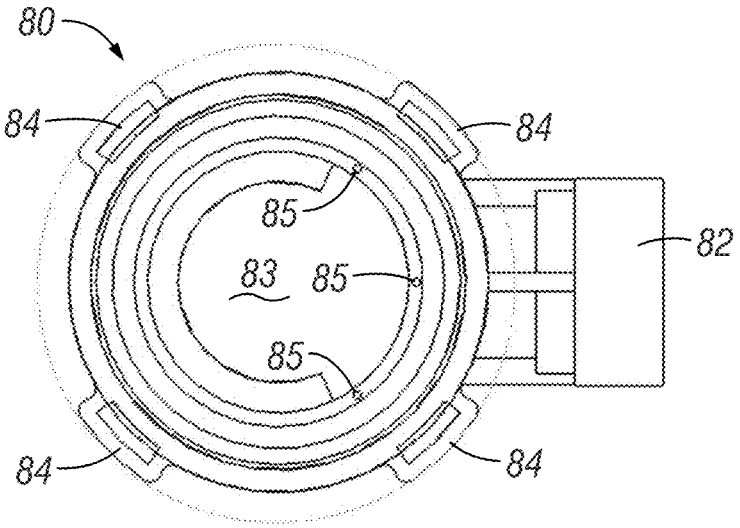
FIG. 17B shows a top section view of the base of FIG. 17A, according to some aspects of the present disclosure.
Figure 17C:
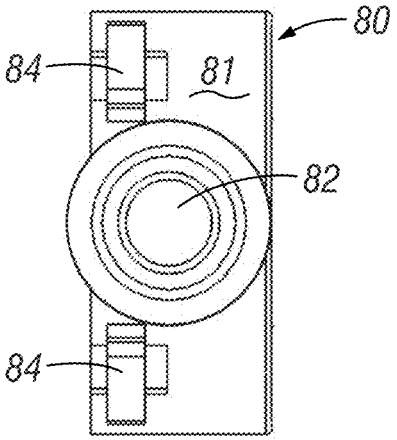
FIG. 17C shows a side section view of the base of FIG. 17A, according to some aspects of the present disclosure.

FIG. 12 presents the rotary fluid valve 38 from yet another perspective than the perspective used in FIG. 6 to show from what perspective the section view of FIG. 13 is presented. FIGS. 12 and 13 are responsible for showing how at least some of the internal components presented in FIGS. 6-11 fit into the rotary fluid valve 38 when the rotary fluid valve 38 is an assembled state.

Referring now to both FIG. 7 and FIGS. 14A-14C, the cap 50 comprises a cap body 51 which functions as a handle. The cap body 51 includes an indicator 52 for indicating which flow paths are open or closed. In the embodiment shown, the cap body 51 is shaped like a six-pointed star knob. The indicator 52 is located at an outer edge (i.e., one of the six points of the star knob shape) on a top surface of the cap body 51. When assembled in the rotary fluid valve 38, the cap body can freely rotate in a clockwise and/or counterclockwise direction tangential to the circumference of the top surface of the cap body 51. As the cap body 51 rotates, a central shaft 53 (seen best in FIG. 13) and a flange or protrusion 54 of the cap body 51 engage, and thereby drive rotation of, the rotatable component 60. The shape of the shaft 53 may even correspond to the shape of the cap body 51. For example, in the embodiment shown, the shaft 53 is hexagonal in nature to correspond with the shape of the cap body 51. The shape of the shaft 53 and cap body 51 in such an embodiment suggests there are up to six reliable positions to which the rotary fluid valve 38 can be adjusted. However, some of these positions may result in redundant flow rates for a fluid moving through the rotary fluid valve 38 depending on how many different flow path combinations are possible within the rotary fluid valve 38. Additionally, the flow rate of a fluid through the rotary fluid valve 38 may be influenced by what degree certain flow paths are open or closed. For example, if the cap body has six reliable positions at 60°, 120°, 180°, 240°, 300°, and 360°, a unique flow rate may be obtained for a fluid running through the rotary fluid valve 38 if the cap body is placed in an imperfect position at 45°. To mitigate this, various mechanisms may be utilized by the cap 50 and/or the rotatable component 60 to help retain or return the rotary fluid valve 38 to one of the intended positions if the rotary fluid valve 38 is moved out of the same.

A static gasket 55 such as an X-ring is positioned in a fitted portion between the rotatable component 60 and the base 80. The static gasket 55 creates a watertight seal between the rotatable component 60 and the base 80.

Referring now to both FIG. 7 and FIGS. 15A-15C, the rotatable component 60 comprises a rotatable component body 61, an indent or recess 62 which for receiving the flange or protrusion 54, a cell 63 (shown as a hexagonal cell) for receiving the shaft 53, a through-hole 64, a rotatable body opening 65, and the rotary disc 66 (shown best in FIGS. 9-11) having rotary disc holes 67. Rotating the rotatable component 60 will cause the rotatable body opening 65 to at least partially align with a fluid inlet 82 of the base 80, thereby causing flow to occur through the rotary fluid valve 38. Alternatively, flow through the rotary fluid valve 38 may be stopped entirely if the rotatable component 60 is rotated such that the rotatable component body 61 completely blocks the fluid inlet 82.

Referring now to both FIG. 7 and FIGS. 16A-16C, the stationary component 70 comprises a disc-shaped stationary component body 71 which, when the rotary fluid valve 38 is assembled, abuts up against the rotary disc 66 of the rotatable component 60. Included on the stationary component body 71 are flow control cavities 72 through which the flow paths 91-93 are defined. Raised surfaces 73 may be included on the stationary component body 71 where fluid exits the flow control cavities 72, i.e., near the circumferential edges of the flow control cavities 72. Also included are ratchets 74 arrayed around a circumferential edge of the stationary component body 71. The ratchet 74 is simply a mechanical device that allows linear motion in only one direction while preventing motion in another direction. In the embodiment shown, each ratchet 74 is actually an elastic (e.g. plastic) arm with a single tooth located towards the top of the ratchet 74. As the stationary component is pushed together with the base 80 during assembly, the elastic nature of the ratchet 74 allows for the ratchet 74 to bend slightly inward while the rachet contacts a pawl 84 until the tooth of the ratchet is completely above the pawl 84. In this position the tooth "clicks" into place and motion in a downward direction is thereby prevented unless the ratchet 74 were again pushed inward by an external force.

A static gasket 55 such as an X-ring is positioned in a fitted portion between the rotatable component 60 and the stationary component 70. The static gasket 55 creates a watertight seal between the rotatable component 60 and the stationary component 70.

Referring now to both FIG. 7 and FIGS. 17A-17C, the base 80 comprises a base body 81, the fluid inlet 82 extending therefrom, a base aperture 83, the pawl 84, and through-holes 85 which help stabilize pressure of a fluid passing through the fluid inlet 82 into the rotary fluid valve 38. When the rotary fluid valve 38 is assembled, the base 80 provides the framework of the rotary fluid valve 38 and serves as a central, outer piece in which other components of the rotary fluid valve 38 may attach. The base body 81 is typically a cylindrical rigid member which comprises a removable cover forming the top surface of the base body. Within the top surface of the base body 81 is the base aperture 83. The base aperture 83 is located towards the top of the base body. The base aperture 83 is shaped to receive in locking engagement the flange or protrusion 54. The pawl 84 is a mechanical component that engages with another component to prevent movement in one direction, or to prevent movement altogether. The opening created by the pawl 84 may be tapered, being wide at the end where the ratchet 74 is inserted and narrow at the engaging end. The pawl 84 is a type of latch. It is to be appreciated the pawl 84 does not need to consist of a spring-loaded solid part that is pivoted at one end and engages the other component at a steep angle at the other end, as is common with some other types of pawls which are intended to be used with ratchet gears.

A preferred method for obtaining a chemical concentration from a chemical composition and a fluid may include introducing the fluid through ports in the manifold diffuse member 30 positioned adjacent a chemical composition and adjusting, with the rotary fluid valve 38, characteristics of the flow of the fluid through the ports in the diffuser manifold 30 to obtain and maintain a chemical concentration. The amount of liquid allowed through the ports modifies the turbulence of the liquid that will contact a chemical product, thereby modifying the erosion rate of the chemical composition. The chemical product can be a solid product, pressed product, cast product, or powder. The characteristics of the flow may include velocity, pressure, turbulence, temperature, flow rate, vector, and/or impingement. The chemical composition may be a solid product and the method may include providing the solid product. The step of adjusting characteristics of the flow may include diverting the fluid through the first flow path 91 or diverting the fluid through a second flow path 92. Alternatively, the rotary fluid valve 38 may simultaneously divert the fluid through both the first flow path 91 and the second flow path 92.

Figure 18:
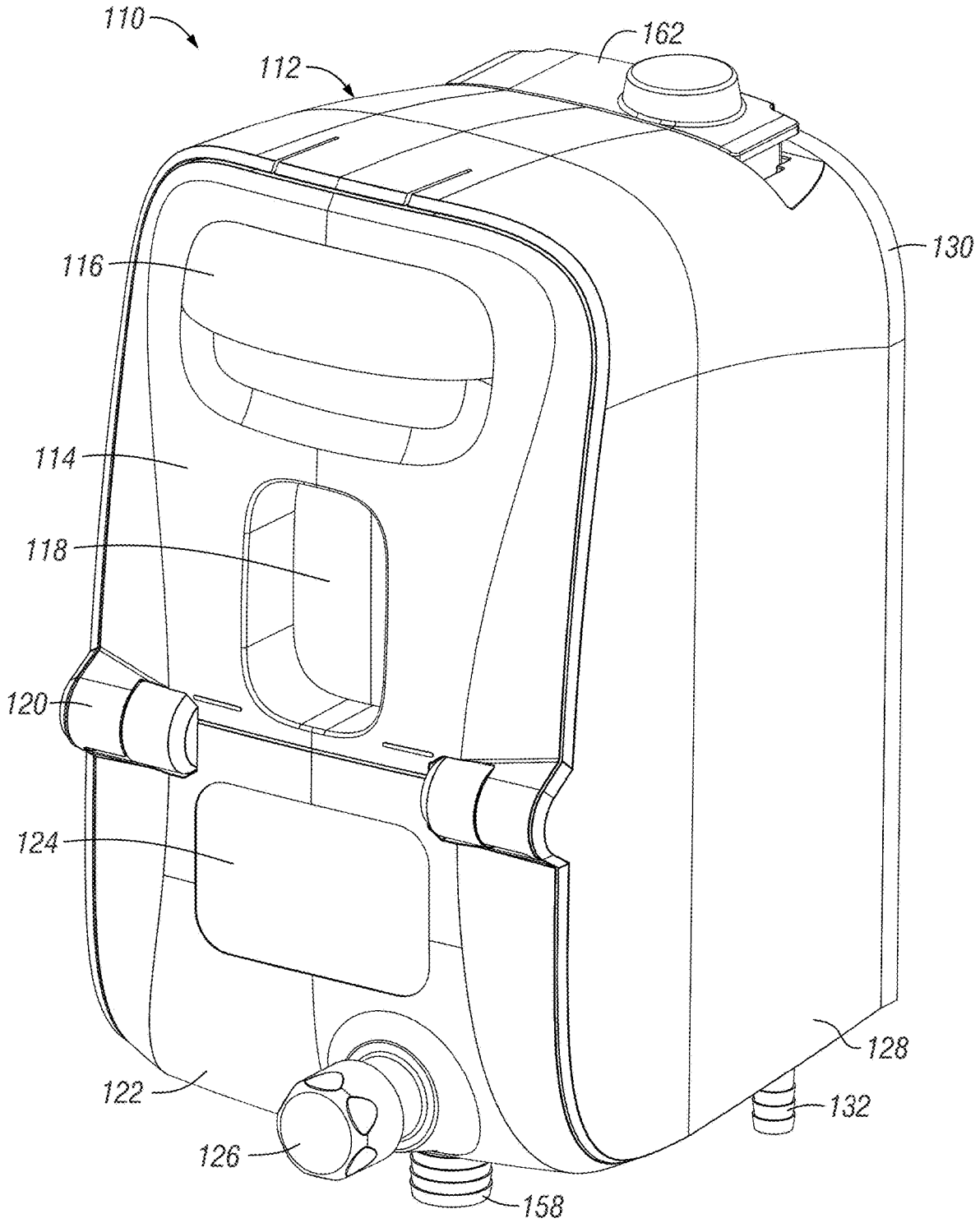
FIG. 18 shows a perspective view of a dispenser, according to some aspects of the present disclosure.

FIG. 18 shows an exemplary embodiment of a dispenser 110 for use with the apparatus. However, it should be noted other types and configurations of dispensers may be used with the apparatus 110, and the description and figures of the dispenser 110 are not to be limiting. The apparatus itself may even form the dispenser 110 with some or all the following limitations.

The dispenser 110 is configured to hold a solid product chemistry that is combined with a liquid, such as water, to create a product chemistry solution. For example, the solid product chemistry may be mixed with the liquid to create a cleaning detergent solution. It should also be appreciated that the product could be mixed with any fluid, such as steam, air, or other gases that erode the product to create a usable chemistry. For example, the solid product could be eroded with a gas or other fluid to create a powder that is dispensed from the dispenser 110 to an end use, such as an appliance. In such a situation, the product could be a solid laundry detergent, which needs to be eroded to powder-like form to be added to a washing machine. The detergent could be eroded by a fluid, such as air or another gas, and the result could be then dispensed into the washing machine, where it will mix with water or other liquids, as is known, to create a liquid detergent for cleaning items.

According to some embodiments, the dispenser 110 works by having the liquid and gas interact with the solid product to form a product chemistry having a desired concentration for its end use application. The liquid may be introduced to a bottom or other surface of the solid product, as will be disclosed.

Therefore, the dispenser 110 of the invention includes a novel turbulence or flow scheme control that is adjustable either manually or in real time (i.e., automatically) based on a characteristic of either the solid product or another uncontrolled condition, such as an environmental condition. The characteristic may be the density of the solid product, the temperature or pressure of the liquid, the climate (humidity, temperature, pressure, etc.) of the room in which the dispenser or solid product is placed, the type of liquid/fluid used, the number of solid products used, or some combination thereof. The dispenser 110 can be adjusted, such as adjusting a characteristic of the existing flow scheme or turbulence. The adjustments may be made based upon the use of known relationships between the characteristic and the erosion rate of the solid product, as well as the relationship between different types of turbulence and the erosion rate of the solid product.

As mentioned, the turbulence or flow characteristics/scheme can be adjusted based upon known relationships between the characteristic(s) and the dispense rate of the solid chemistry. For example, by understanding the rate change of product dispense per change in degree of liquid temperature change, the turbulence can be adjusted to counteract a temperature change. The concentration is adjusted according to known relationships between the erosion or dispense rate and either the characteristic or the turbulence.

According to the exemplary embodiment, the dispenser 110 includes a housing 112 comprising a front door 114 having a handle 116 thereon. The door 114 is mounted to the housing in any convenient manner. For example, the front door 114 may be hingeably connected to a front fascia 122 via hinges 120 therebetween. This allows the front door 114 to be rotated about the hinge 120 to allow access into the housing 112 of the dispenser 110. The front door 114 also includes a window 118 therein to allow an operator to view the solid product housed within the housing 112. Once the housed product has been viewed to erode to a certain extent, the front door 114 can be opened via the handle to allow an operator to replace the solid product with a new un-eroded product.

The front fascia 122 may include a product ID window 124 for placing a product ID label thereon. The product ID window 124 allows an operator to quickly determine the type of product housed within the housing 112 such that replacement thereof is quick and efficient. The ID label may also include other information, such as health risks, manufacturing information, date of last replacement, or the like. The dispenser may be activated in various ways, such as a push button, a switch, or a touch sensitive pad. For example, in one embodiment, a push button 126 is mounted to the front fascia 122 for activating the dispenser 110. The button 126 may be a spring-loaded button such that pressing or depressing of the button activates the dispenser 110 to discharge an amount of product chemistry solution via an outlet 158 created by the solid product and the liquid. Thus, the button 126 may be preprogrammed to dispense a desired amount per pressing of the button or may continue to discharge an amount of product chemistry while the button is depressed.

Connected to the front fascia 122 is a rear enclosure 128, which generally covers the top, sides, and rear of the dispenser 110. The rear enclosure 128 may also be removed to access the interior of the dispenser 110. A mounting plate 130 is positioned at the rear of the dispenser 110 and includes means for mounting the dispenser to a wall or other structure. For example, the dispenser 110 may be attached to a wall via screws, hooks, or other hanging means attached to the mounting plate 130.

The components of the housing 112 of the dispenser 110 may be molded plastic or other materials, and the window 118 may be a transparent plastic such as clarified polypropylene or the like. The handle 116 can be connected and disconnected from the front door 114. In addition, a backflow prevention device 162 may be positioned at or within the rear enclosure 128 to prevent backflow of the product chemistry.

Figure 19:
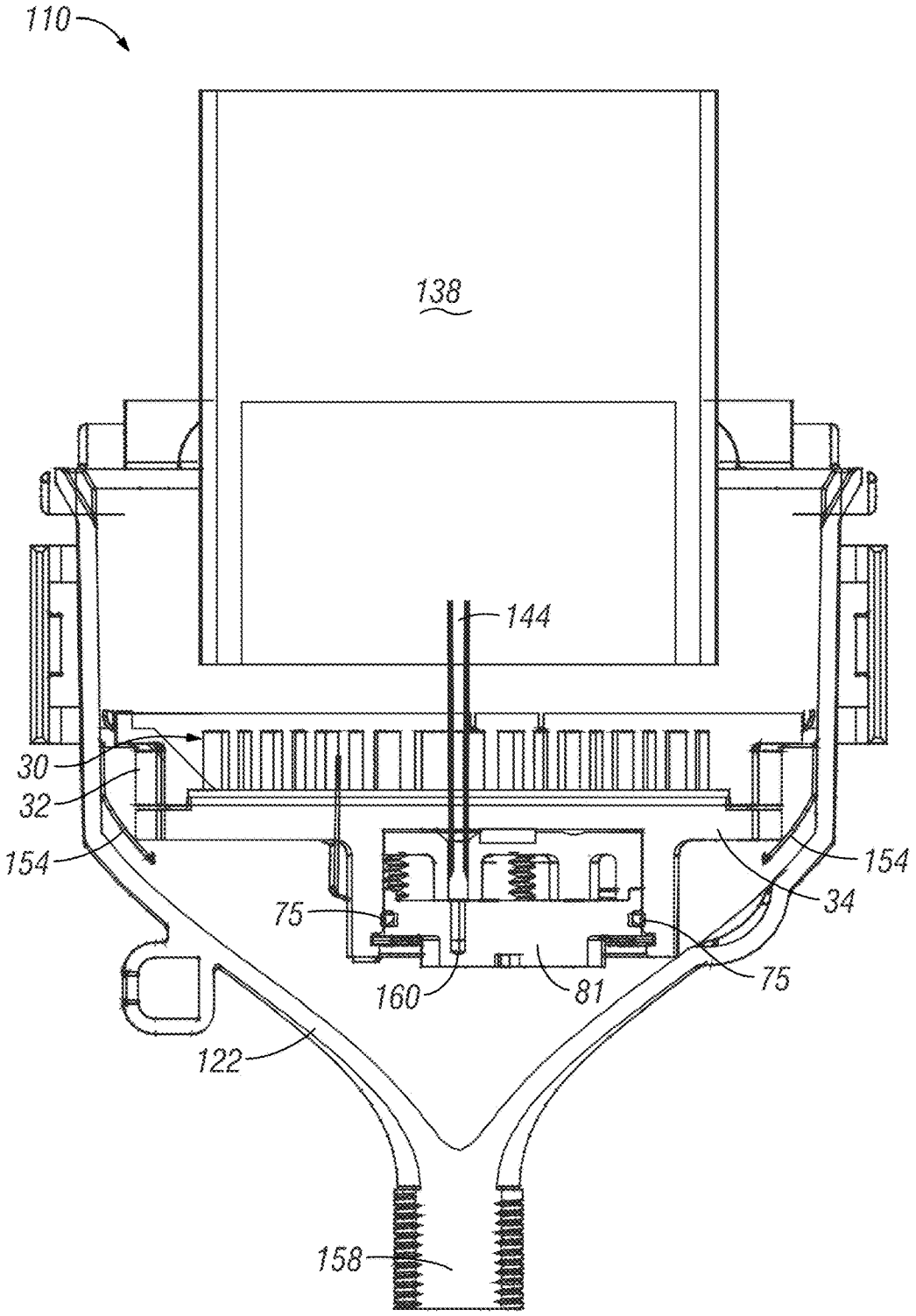
FIG. 19 shows a side section view of the dispenser of FIG. 18, according to some aspects of the present disclosure.
Figure 20:
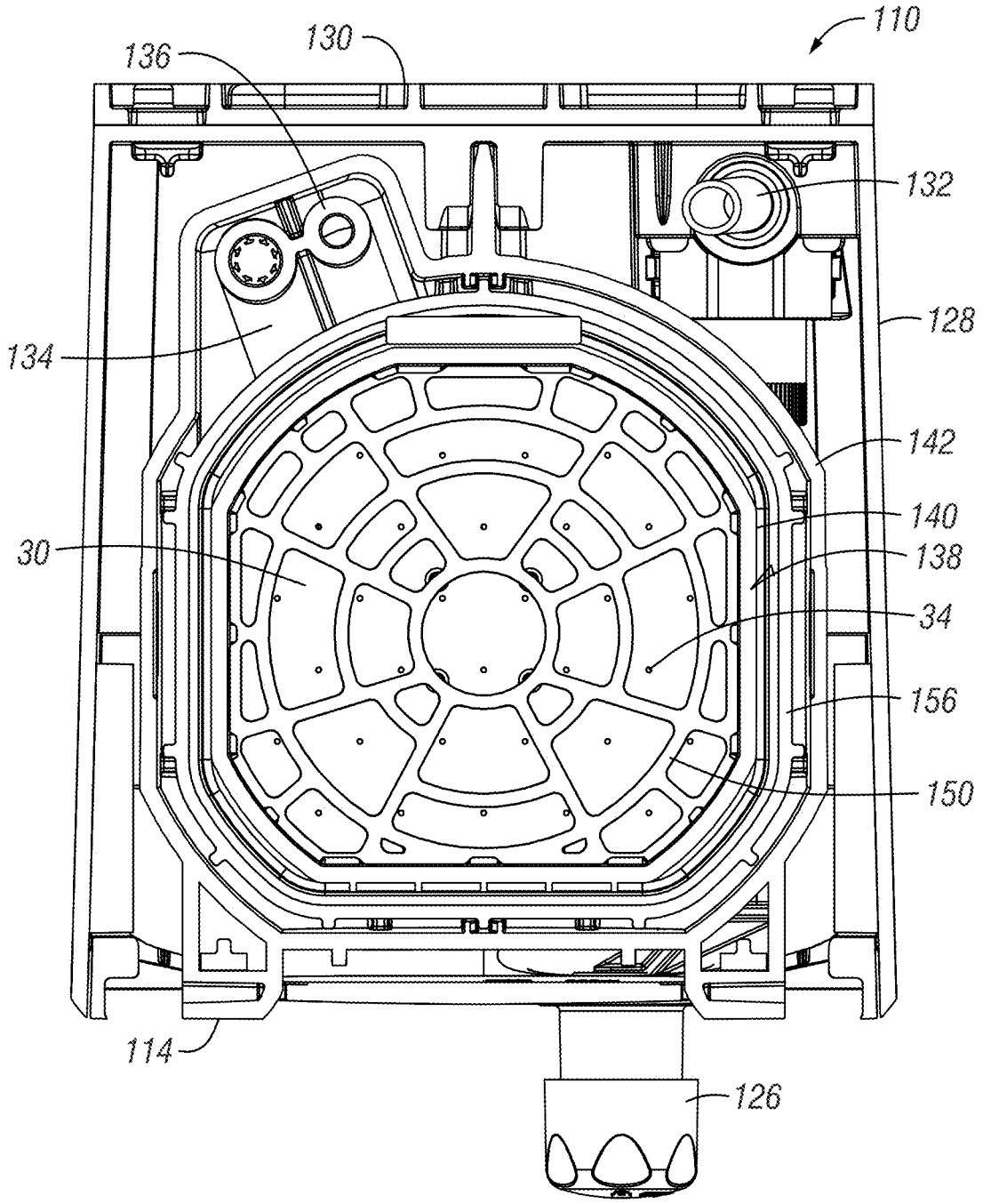
FIG. 20 shows a top section view of the dispenser of FIG. 18, according to some aspects of the present disclosure.

FIGS. 19-20 are side and top section views of the dispenser 110. A solid product is placed within a cavity 138, which is surrounded by walls 140. The solid product chemistry is placed on a support member 150, which is shown to be a product grate comprising interlocking wires. A liquid, such as water, is connected to the dispenser 110 via the liquid inlet 132 shown in FIG. 20 on the bottom side of the dispenser 110. The liquid is connected to the button 126 such that pressing the button will pass liquid into the dispenser 110 to come in contact with the product chemistry. The liquid is passed through a liquid source 134 via a fitment splitter 136. As shown, the liquid source 134 is a split, two channel liquid source for different flow paths. Each of the paths contains a flow control (not shown) to properly distribute liquid in the intended amounts. This flow control can be changed to alter the turbulence of the liquid coming in contact with the solid product to adjust the turbulence based on the characteristics to maintain the formed product chemistry within an acceptable range of concentration. For example, the liquid may pass through the liquid source 134 and out the liquid source nozzle 144. The liquid source nozzle 144 is positioned adjacent a diffuser manifold 30, such that the liquid passing through the liquid nozzle 144 will be passed through manifold diffuse ports 34 of the diffuser manifold 30.

Furthermore, the invention contemplates that, while positioned on the support member 150, the product chemistry may be fully submerged, partially submerged, or not submerged at all. The submersion level, or lack thereof, can be dependent upon many factors, including, but not limited to, the chemistry of the product, the desired concentration, the fluid used to erode the chemistry, frequency of use of the dispenser, along with other factors. For example, for normal use with water as the eroding element, it has been shown that it is preferred to have approximately one-quarter inch of the bottom portion of the product chemistry submerged to aid in controlling the erosion rate of the chemistry. This will provide for a more even erosion of the product as it is used, so that there will be less of a chance of an odd amount of product left that must be discarded or otherwise wasted.

The liquid will continue in a generally upwards orientation to come in contact with a portion or portions of the solid product supported by the product grate 150. The mixing of the liquid and the solid product will erode the solid product, which will dissolve portions of the solid product in the liquid to form a product chemistry. This product chemistry will be collected in the product chemistry collector 156, which is generally a cup-shaped member having upstanding walls and bottom floor comprising the diffuser manifold 30. The product chemistry will continue to rise in the product chemistry collector 156 until it reaches the level of an overflow port, which is determined by the height of the wall comprising the product chemistry collector 156. According to an aspect, the product chemistry collector 156 is formed by the manifold diffuse member 32 and walls extending upward therefrom. The height of the walls determines the location of the overflow port. The product chemistry will escape or pass through the overflow port and into the collection zone 142, in this case a funnel. The liquid source 134 includes a second path, which ends with the diluent nozzle 160. Therefore, more liquid may be added to the product chemistry in the collection zone 142 to further dilute the product chemistry to obtain a product chemistry having a concentration within the acceptable range.

Other components of the dispenser 110 include a splash guard 154 positioned generally around the top of the collection zone 142. The splash guard 154 prevents product chemistry in the collection zone 142 from spilling outside the collection zone 142.

According to additional aspects of the present disclosure, the dispenser 110 may also include components such as an intelligent control and communication components. Examples of such intelligent control units may be central processing units alone or in tablets, telephones, handheld devices, laptops, user displays, or generally any other computing device capable of allowing input, providing options, and showing output of electronic functions. Still further examples include a microprocessor, a microcontroller, or another suitable programmable device) and a memory. The apparatus also can include other components and can be implemented partially or entirely on a semiconductor (e.g., a field-programmable gate array ("FPGA")) chip, such as a chip developed through a register transfer level ("RTL") design process. The memory includes, in some embodiments, a program storage area and a data storage area. The program storage area and the data storage area can include combinations of different types of memory, such as read-only memory ("ROM"), random access memory ("RAM") (e.g., dynamic RAM ("DRAM"), synchronous DRAM ("SDRAM"), etc.), electrically erasable programmable read-only memory ("EEPROM"), flash memory, a hard disk, an SD card, or other suitable magnetic, optical, physical, or electronic memory devices.

A communications module can be included with the dispenser and can be configured to connect to and communicate with a controller, such as a computer, tablet, server, handheld (phone or otherwise), or other computing device. This could allow the dispenser to provide data or other information (e.g., warnings, status, notices, etc.) associated with the dispenser to a remote location of the controller to allow the real-time information and stored information for the dispenser. The information could be used to determine issues, forecast, make changes to the operation, or otherwise track information related to the dispenser. The communication could also be in the form of inputs such that the communication could include a command to the dispenser from a remote location.

In some embodiments, the dispenser includes a first communications module for communicating with a secondary device (other dispenser or remote controller), and/or a second communications module for communicating with a central location (server, computer, or other master controller). For sake of simplicity, the term "communications module" herein applies to one or more communications modules individually or collectively operable to communicate with both the dispenser and the central location.

The communications module communicates with the central location through the network. In some embodiments, the network is, by way of example only, a wide area network ("WAN") (e.g., a global positioning system ("GPS"), a TCP/IP based network, a cellular network, such as, for example, a Global System for Mobile Communications ("GSM") network, a General Packet Radio Service ("GPRS") network, a Code Division Multiple Access ("CDMA") network, an Evolution-Data Optimized ("EV-DO") network, an Enhanced Data Rates for GSM Evolution ("EDGE") network, a 3GSM network, a 4GSM network, a Digital Enhanced Cordless Telecommunications ("DECT") network, a Digital AMPS ("IS-136/TDMA") network, or an Integrated Digital Enhanced Network ("iDEN") network, etc.), although other network types are possible and contemplated herein. In certain embodiments, the network is a GSM or other WAM which is operable to allow communication between the communications module and the central location during moments of low-quality connections, such as but not limited to when the dispenser is near a window.

The network can be a local area network ("LAN"), a neighborhood area network ("NAN"), a home area network ("HAN"), or personal area network ("PAN") employing any of a variety of communications protocols, such as Wi-Fi, Bluetooth, ZigBee, near field communication ("NFC"), etc., although other types of networks are possible and are contemplated herein. Communications through the network by the communications module or the controller can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), and the like.

The connections between the communications module and the network are wireless to enable freedom of movement and operation of the dispenser 110 without being physically tethered to a computer or other external processing device to facilitate such communications. Although such a modality of communications is preferred for at least this reason, it is contemplated that the connections between the communications module and the network can instead be a wired connection (e.g., a docking station for the communications module, a communications cable releasably connecting the communications module and a computer or other external processing device, or other communications interface hardware), or a combination of wireless and wired connections. Similarly, the connections between the controller and the network or the network communications module are wired connections, wireless connections, or a combination of wireless and wired connections in any of the forms just described. In some embodiments, the controller or communications module includes one or more communications ports (e.g., Ethernet, serial advanced technology attachment ("SATA"), universal serial bus ("USB"), integrated drive electronics ("IDE"), etc.) for transferring, receiving, or storing data.

The central location can include a centrally located computer, a network of computers, or one or more centrally located servers. The central location can be adapted to store, interpret, and communicate data from one or more dispensers 110, and can also interpret the data and communicate the interpreted data to a user.

The dispenser and/or components thereof may be powered in a number of ways. It is contemplated that the system be hard-wired, cord and plug connected, or otherwise powered, such as to AC power plugs and sockets. A hardwired appliance is one where the building wiring method attaches to the appliance in a more permanent fashion. This will involve splicing of wires inside the appliance or in a junction box. Cord and plug connected appliances have a cord with a molded plug that is either factory or field installed on the appliance. The appliance is then ready to be plugged in to a receptacle in the location it is permanently installed. The hard-wired power source could be on a power grid, or could be a separate generator, battery, or other source. The wire could provide power over Ethernet or via USB cable, such as if the system is connected in such a manner. Still further, it is contemplated that the system be self-powered or include on-board power, in that there is no wiring to a separate power source. Such a configuration could include batteries in the system, such as non-rechargeable (e.g., dry battery) or rechargeable (e.g., Lithium-ion) type batteries. Still further, other types of power, such as, but not limited to, solar, piezoelectric sources, and the like, which can provide additional amounts of power.

From the foregoing, it can be seen that the present invention accomplishes at least all of the stated objectives.

LIST OF REFERENCE NUMERALS

The following list of reference numerals is provided to facilitate an understanding and examination of the present disclosure and is not exhaustive. Provided it is possible to do so, elements identified by a numeral may be replaced or used in combination with any elements identified by a separate numeral. Additionally, numerals are not limited to the descriptors provided herein and include equivalent structures and other objects possessing the same function.

30 diffuser manifold
32 manifold diffuse member
34 manifold diffuse member ports
36 valve housing
38 rotary fluid valve
40 mounting apertures
42 mounting tab
44 first fluid path
46 second fluid path
48 support members
50 cap
51 cap body
52 indicator
53 shaft
54 flange or protrusion
55 static gasket (e.g., an X-ring)
60 rotatable component
61 rotatable component body
62 indent or recess
63 cell
64 through-hole
65 rotatable body opening
66 rotary disc
67 rotary disc holes
68 valve/compression seal (e.g. rubber or silicone plugs)
69 static gasket (e.g., an O-ring)
70 stationary component
71 stationary component body
72 flow control cavity
73 raised surface
74 ratchet
75 static gasket (e.g., an X-ring)
80 base
81 base body
82 fluid inlet
83 base aperture
84 pawl
85 base gates
91 first flow path
92 second flow path
93 third flow path
110 dispenser
112 housing
114 front door
116 handle
118 viewing window
120 hinges
122 front fascia
124 product ID window
126 push button
128 rear enclosure
130 mounting plate
132 liquid inlet
134 liquid source
136 fitment splitter
138 cavity
140 walls
142 collection zone
144 liquid source nozzle
148 manifold diffuse ports
150 support member
152 overflow port
154 splash guard
156 chemistry collector
158 outlet
160 diluent nozzle
162 backflow prevention device The present disclosure is not to be limited to the particular embodiments described herein. The following claims set forth a number of the embodiments of the present disclosure with greater particularity.

What is claimed is:

1. An apparatus for adjusting characteristics of the flow of a fluid contacting a solid product to form a product chemistry comprising:

a diffuser manifold having a manifold diffuse member comprising:

a first side with ports therethrough; and a second side having a first fluid path and a second fluid path determined by a flow geometry of the manifold diffuse member, the first fluid path and the second fluid path intersected by the ports; and a fluid valve for controlling the flow rate of a fluid moving through the plurality of ports and having at least three configurations that allow for selectively orienting a flow of the fluid through, in a first configuration, a first flow path, a second flow path, and a third flow path; in a second configuration, the first flow path and the third flow path; and in a third configuration, a second flow path and the third flow path;

wherein the first flow path, the second flow path, and the third flow path are fluidly parallel with each another in the first configuration.

2. The apparatus of claim 1 wherein the fluid valve has a fourth configuration wherein the flow is permitted to move through only the third flow path.

3. The apparatus of claim 1 further comprising a means for selectively closing the third flow path.

4. The apparatus of claim 1 wherein fluid diverted through the first flow path travels through the first fluid path and fluid diverted through the second flow path travels through the second fluid path.

5. The apparatus of claim 1 wherein the fluid valve further comprises a static gasket to seal off the first flow path or the second flow path.

6. The apparatus of claim 1 wherein the fluid valve comprises an external component for driving rotation of an internal rotatable component.

7. The apparatus of claim 6 wherein the external component includes an indicator for indicating which flow paths are open or closed.

8. The apparatus of claim 6 wherein the rotatable component includes a rotary disc with holes therethrough, some of the apertures being plugged by valve seals.

9. The apparatus of claim 1 wherein the fluid valve further comprises a stationary component which attaches to a base to form at least a portion of an external structure of the fluid valve.

10. The apparatus of claim 9 wherein the stationary component comprises flow control cavities and raised surfaces where the fluid exits the flow control cavities.

11. The apparatus of claim 9 wherein the fluid valve comprises a static gasket for creating a watertight seal between the stationary component and the base.

12. The apparatus of claim 9 wherein the stationary component and the base are attached with a ratchet and a pawl.

13. The apparatus of claim 1 wherein the ports have varying diameters.

14. A dispenser configured to obtain a product chemistry from a product and a liquid comprising:

a housing;

a cavity within the housing for holding the product;

a liquid source adjacent the cavity for providing a liquid to contact the product to create a product chemistry; and the apparatus of claim 1.

15. The dispenser of claim 14 further comprising an outlet operatively connected to the cavity to dispense the product chemistry from the dispenser.

16. The dispenser of claim 14 wherein the diffuser manifold is removably secured within the dispenser.

17. A method for using the apparatus of claim 1 and obtaining a chemical concentration from a chemical composition and a fluid, said method comprising:

introducing the fluid through the ports in the manifold diffuse member positioned adjacent the chemical composition; and adjusting, with the fluid valve, characteristics of the flow of the fluid through the ports in the diffuser manifold to obtain and maintain the chemical concentration;

wherein the amount of fluid allowed through the ports modifies the turbulence of the fluid, thereby modifying the erosion rate of the chemical composition.

18. The method of claim 17 wherein the characteristics of the flow include:

a. velocity, b. pressure, c. turbulence, d. temperature, e. flow rate, f. vector, and/or g. impingement.

19. The method of claim 18 wherein the step of adjusting characteristics of the flow comprises diverting the fluid through a first flow path, a second flow path, or a third flow path.

20. The method of claim 19 wherein fluid diverted through the first flow path travels through a first fluid path determined by a flow geometry of the manifold diffuse member and fluid diverted through the second flow path travels through a second fluid path determined by said flow geometry.

* * * * *